US009962008B1

(12) United States Patent
Omiste

(10) Patent No.: US 9,962,008 B1
(45) Date of Patent: May 8, 2018

(54) MODULAR MULTI-COMPONENT MATTRESS

(71) Applicant: MVMNT Sleep Systems, LLC, Centerville, UT (US)

(72) Inventor: Alvaro Omiste, Salt Lake City, UT (US)

(73) Assignee: MVMNT Sleep Systems, LLC, Centerville, UT (US)

( * ) Notice: Subject to any disclaimer, the term of this patent is extended or adjusted under 35 U.S.C. 154(b) by 0 days. days.

(21) Appl. No.: 15/390,113

(22) Filed: Dec. 23, 2016

(51) Int. Cl.

| | |
|---|---|
| ***A47C 27/00*** | (2006.01) |
| ***A47C 27/15*** | (2006.01) |
| ***A47C 27/14*** | (2006.01) |
| ***A47C 21/04*** | (2006.01) |

(52) U.S. Cl.
CPC ..... *A47C 27/001* (2013.01); *A47C 21/046* (2013.01); *A47C 21/048* (2013.01); *A47C 27/007* (2013.01); *A47C 27/144* (2013.01); *A47C 27/148* (2013.01); *A47C 27/15* (2013.01)

(58) Field of Classification Search
CPC ..... A47C 27/00; A47C 27/001; A47C 27/14; A47C 27/142; A47C 27/144; A47C 27/148; A47C 27/15; A47C 21/042; A47C 21/046
USPC ... 5/421, 690, 691, 722–724, 727, 728, 740, 5/655.9, 953
See application file for complete search history.

(56) References Cited

U.S. PATENT DOCUMENTS

| | | | | | |
|---|---|---|---|---|---|
| 2,216,991 | A * | 10/1940 | Trovillo | A47C 27/001 | 5/716 |
| 3,209,380 | A * | 10/1965 | Watsky | A47C 27/144 | 297/452.47 |
| 3,210,781 | A * | 10/1965 | Pollock | A47C 27/001 | 267/91 |
| 3,274,624 | A * | 9/1966 | Noerdinger | A47C 27/081 | 24/585.1 |
| 5,953,779 | A * | 9/1999 | Schwartz | A47C 27/001 | 5/692 |
| 6,085,373 | A * | 7/2000 | Montana | A47C 27/001 | 5/722 |
| 6,182,314 | B1 * | 2/2001 | Frydman | A47C 20/021 | 128/845 |
| 6,345,401 | B1 * | 2/2002 | Frydman | A47G 9/10 | 5/636 |
| 7,293,311 | B2 * | 11/2007 | Baker | A47C 27/001 | 5/721 |

(Continued)

*Primary Examiner* — Robert G Santos
(74) *Attorney, Agent, or Firm* — Dax D. Anderson; Kirton McConkie

(57) ABSTRACT

A modular multi-component mattress system includes a base layer with a coupling channel, a first reversible support pad assembly with a first side rail and a second side rail, a comfort pad layer, and a cover assembly configured to contain the base layer, the first reversible support pad assembly, and the comfort pad layer. In a first configuration, the first side rail detachably and selectively couples within the coupling channel and the second side rail receives the comfort pad layer. In a second configuration, the first side rail receives the comfort pad layer and the second side rail detachably and selectively couples within the coupling channel. The system includes a second reversible support pad assembly. The system includes a topper layer with a cool comfort side and a warm comfort side. The topper layer detachably and selectively couples with the cover assembly.

15 Claims, 20 Drawing Sheets

(56) References Cited

U.S. PATENT DOCUMENTS

| | | | | |
|---|---|---|---|---|
| 7,574,762 | B2 * | 8/2009 | Baker | A47C 27/001 5/721 |
| 8,209,804 | B2 * | 7/2012 | Apperson | A47C 27/05 5/691 |
| 8,800,978 | B2 * | 8/2014 | Tarazona De La Asuncion | A42B 3/128 267/142 |
| 9,167,909 | B2 * | 10/2015 | Cappadona | A47C 27/002 |
| 2005/0193497 | A1 * | 9/2005 | Baker | A47C 27/001 5/721 |
| 2006/0042008 | A1 * | 3/2006 | Baker | A47C 27/001 5/271 |
| 2006/0260059 | A1 * | 11/2006 | Apperson | A47C 27/05 5/691 |
| 2006/0260060 | A1 * | 11/2006 | Apperson | A47C 27/05 5/691 |
| 2010/0264571 | A1 * | 10/2010 | Tarazona De La Asuncion | A42B 3/128 267/141 |
| 2011/0083277 | A1 * | 4/2011 | Henson | A47C 27/144 5/655.9 |
| 2014/0259429 | A1 * | 9/2014 | Clayton | A47C 27/144 5/691 |
| 2015/0265063 | A1 * | 9/2015 | Cappadona | A47C 27/002 5/698 |

* cited by examiner

MODULAR MULTI-COMPONENT MATTRESS

BACKGROUND

This disclosure pertains to modular multi-component mattresses. More particularly, some implementations of the present disclosure relate to systems and methods for providing a modular multi-component mattress configured to be customizable by a user.

Conventional mattresses typically comprise a core support layer encased in an upholstery layer. The firmness, support, feel, and other characteristics are determined by the materials contained in the core support layer and the arrangement of these materials in the core support layer. The materials contained in the core support layer and the arrangement of these materials in the core support layer are determined during manufacture of the mattress and cannot be changed or customized by a user once the mattress has been manufactured. Therefore, many users purchase a mattress by going to a mattress store, briefly reclining on a variety of different mattresses, selecting a mattress that appears to suit the user's preferences for firmness and temperature, and then purchasing the selected mattress. Once purchased, the selected mattress cannot be customized by the user should he or she be unsatisfied with the mattress or should his or her preferences change. Exchange of the selected mattress after purchase is also difficult because of the large and bulky nature of the selected mattress and the need to return the entire unit for exchange. Because of this, return and/or exchange of the mattress often requires a user to hire a delivery company to return the mattress or to find a friend with a pickup truck willing to help return the mattress.

Some conventional mattress distributors do offer direct-to-consumer purchase and delivery of mattresses. In these cases, the user can order a mattress with different options including firmness levels, fabrics, and other similar options. After purchase, the mattress with the selected options is delivered to the user. Unfortunately, after purchase the user is unable to customize the purchased mattress should he or she be unsatisfied with the mattress or should his or her preferences change. In these cases, the user must return the purchased mattress to the direct-to-consumer mattress distributor.

Although some conventional mattresses do offer a variety of options such as firmness, support, and feel, once purchased, the mattress cannot be customized by the user should he or she be unsatisfied with the mattress or should his or her preferences change. One of the few options that the user has is to return and/or exchange the large, bulky, and/or difficult to transport mattress.

Thus, while conventional mattresses do offer a variety of options, challenges still exist, including those listed above. Accordingly, it would be an improvement in the art to augment or even replace current techniques with other techniques.

BRIEF SUMMARY

Described herein are some embodiments of a modular multi-component mattress. In some embodiments, the modular multi-component mattress comprises a mattress core comprising a base layer, a first support pad assembly, and a comfort pad layer. In some cases, the first support pad assembly can comprises a first side rail configured to detachably and selectively couple within a coupling channel in the base layer. The first support pad assembly can also comprise a second side rail configured to receive the comfort pad layer. The first support pad assembly can be configured to be reversible such that the second side rail is also configured to detachably and selectively couple within the coupling channel of the base and the first side rail is also configured to receive the comfort pad layer. The mattress core can further comprising a second support pad assembly comprising a third side rail configured to detachably and selectively couple within a coupling channel in the base layer. The second support pad assembly can also comprise a fourth side rail configured to receive the comfort pad layer. The second support pad assembly can be configured to be reversible such that the fourth side rail is also configured to detachably and selectively couple within the coupling channel of the base and the third side rail is also configured to receive the comfort pad layer. The comfort pad layer can be configured to provide a temperature comfort preference to a user. The mattress core can comprise ventilation channels.

In some embodiments, a modular multi-component mattress system comprises a mattress core comprising a base layer, a first support pad assembly, a second support pad assembly and a comfort pad layer, a cover assembly configured to contain the mattress core, and a topper layer configured to detachably and selectively couple to the cover assembly. The first support pad assembly and the second support pad assembly can be configured to detachably and selectively couple to the base layer. The first support pad assembly can comprise a first side rail configured to detachably and selectively couple within a coupling channel in the base layer and a second side rail configured to receive the comfort pad layer. The second support pad assembly can comprise a third side rail configured to detachably and selectively couple within a coupling channel in the base layer and a fourth side rail configured to receive the comfort pad layer. The first support pad assembly and the second support pad assembly can comprise vents configured to allow passage of one or more of air, heat, and moisture between the mattress system and a surrounding environment. The comfort pad layer can also comprise channels configured to allow passage of one or more of air, heat, and moisture between the mattress system and a surrounding environment. The topper layer can comprises a topper pad comprising a cool comfort side and a warm comfort side.

In some embodiments, a modular multi-component mattress system comprises a base layer comprising a coupling channel, a first reversible support pad assembly comprising a first side rail and a second side rail, a comfort pad layer, and a cover assembly configured to contain the base layer, the first reversible support pad assembly, and the comfort pad layer, where, in a first configuration, the first side rail is configured to detachably and selectively couple within the coupling channel and the second side rail is configured to receive the comfort pad layer, and where, in a second configuration, the first side rail is configured to receive the comfort pad layer and the second side rail is configured to detachably and selectively couple within the coupling channel. In other embodiments, the mattress system further comprises a second reversible support pad assembly. In yet other embodiments, the mattress system further comprises a topper layer comprising a cool comfort side and a warm comfort side. In some embodiments, the topper layer is configured to detachably and selectively couple with the cover assembly.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The present disclosure relates to modular multi-component mattresses. More particularly, some embodiments of the present disclosure relate to systems and methods for providing a modular multi-component mattress configured to be customizable by a user. While the modular multi-component mattress can have any suitable component, in some cases, it includes one or more of a cover, a base, a support layer, and a comfort layer.

In the disclosure and in the claims, the term mattress (and variations thereof) may be used to refer to any large pad assembly for supporting a reclining user including any large pad assembly used as a bed or as part of a bed. The term mattress can include a bed, a part of a bed, a cushion, a pallet, a futon, a divan, a sleeping pad, an adjustable mattress, a memory foam mattress, and/or any other similar assemblies and/or sleeping furniture.

Figure 1:
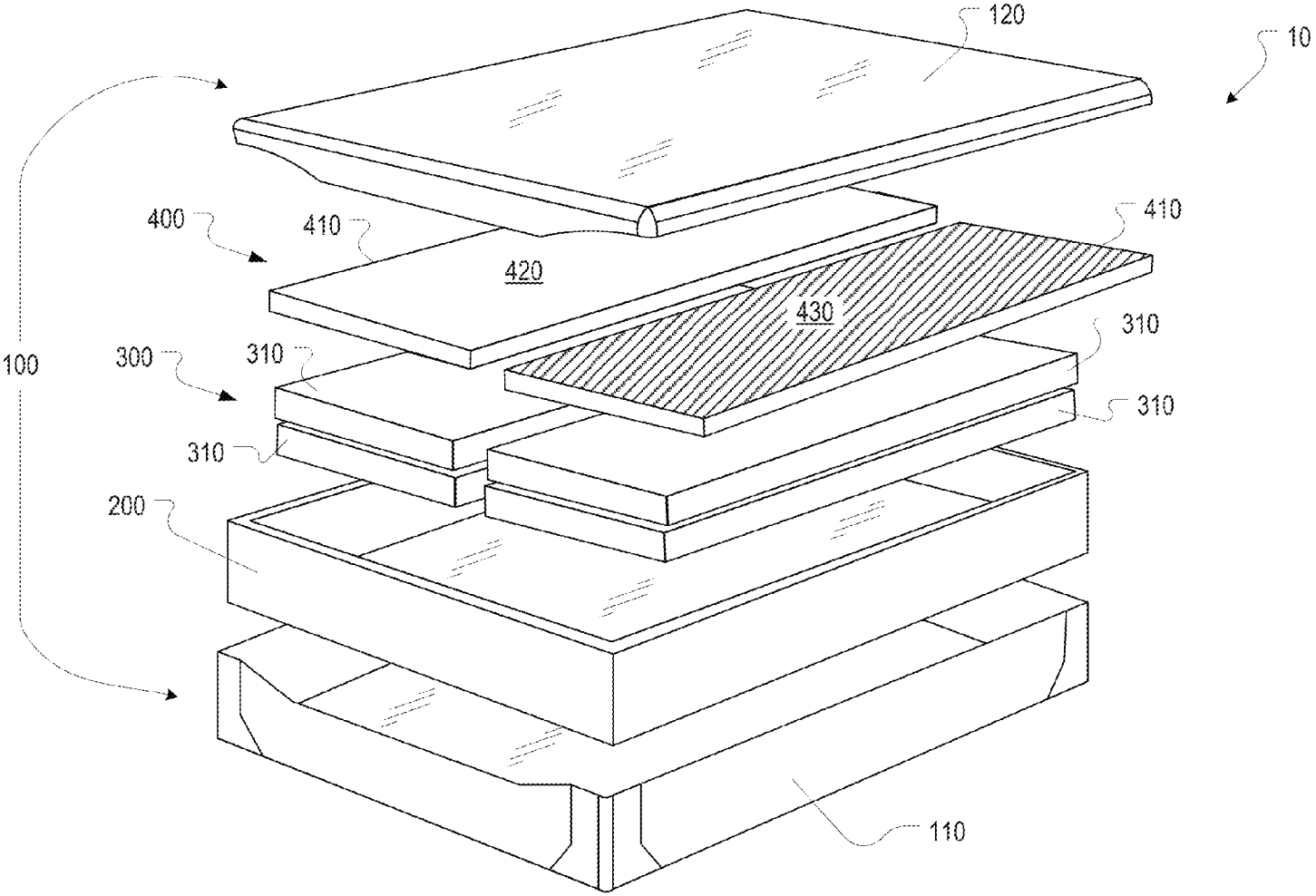
FIG. 1 illustrates a front perspective view of embodiments of a modular multi-component mattress.

In general (and as mentioned above), some embodiments of the described systems and methods relate to a modular multi-component mattress. While the described modular multi-component mattress can comprise any suitable component or characteristic, FIG. 1 shows that at least in some embodiments, the modular multi-component mattress 10 (or mattress assembly) comprises one or more of a cover 100, a base 200, a supporting layer 300, and a comfort layer 400. In other embodiments, the cover 100 is configured to enclose the other components of the mattress 10 and/or to serve as an outer layer of the mattress 10. The cover 100 can comprise more than one section and can include a bottom cover portion 110 and a top cover portion 120. The mattress 10 can also comprise a base 200 configured to fit within the cover 100. The base 200 can also be configured to contain the supporting layer 300. The base 200 can also be configured to provide edge support to the mattress 10. The supporting layer 300 can be configured to fit within the base 200 and to provide support to the mattress 10. The comfort layer 400 can be configured to cover the supporting layer 300 and to provide a temperature comfort preference to the user.

Additionally, FIG. 1 also shows that, at least in some embodiments, the supporting layer 300 comprises one or more support pads 310 of differing firmness. The user can combine support pads 310 of differing firmness to achieve a preferred firmness. For example, the user can pair support pads 310 of medium firmness to achieve a preferred medium firmness. Likewise, the user can pair support pads 310 of soft firmness to achieve a preferred soft firmness. Similarly, the comfort layer 400 can comprise one or more temperature comfort pads 410. The temperature comfort pads 410 can be configured with a cool comfort side 420 and a warm comfort side 430. The cool comfort side 420 can be configured to feel cool to the touch and to feel cool to the user when the user lays on it. The warm comfort side 430 can be configured to feel warm to the touch and to feel warm when the user lays on it. The user can adjust the temperature comfort preference by selecting the side (e.g., cool comfort side 420 or warm comfort side 430) of the temperature comfort pad 410 that will provide the desired temperature comfort preference and placing that side of the temperature comfort pad 410 facing up so that it will be closest to the user and provide the desired temperature comfort preference.

In certain embodiments, air, temperature and moisture transfer through the mattress assembly in FIG. 1 is promoted by layering components without continuous bonding or adhering the assembly together, thus avoiding barriers which would inhibit transfer. This same principle is used in the assembly with the same elements disclosed in FIG. 1 as well as other embodiments disclosed herein. Additionally, transport channels, which may comprise vents, channels, holes, cavities or fibers which wick moisture or transport heat can be provided to permit the transport of one or more of air, heat, and moisture away from the surface where a user using the mattress is positioned.

Figure 2:
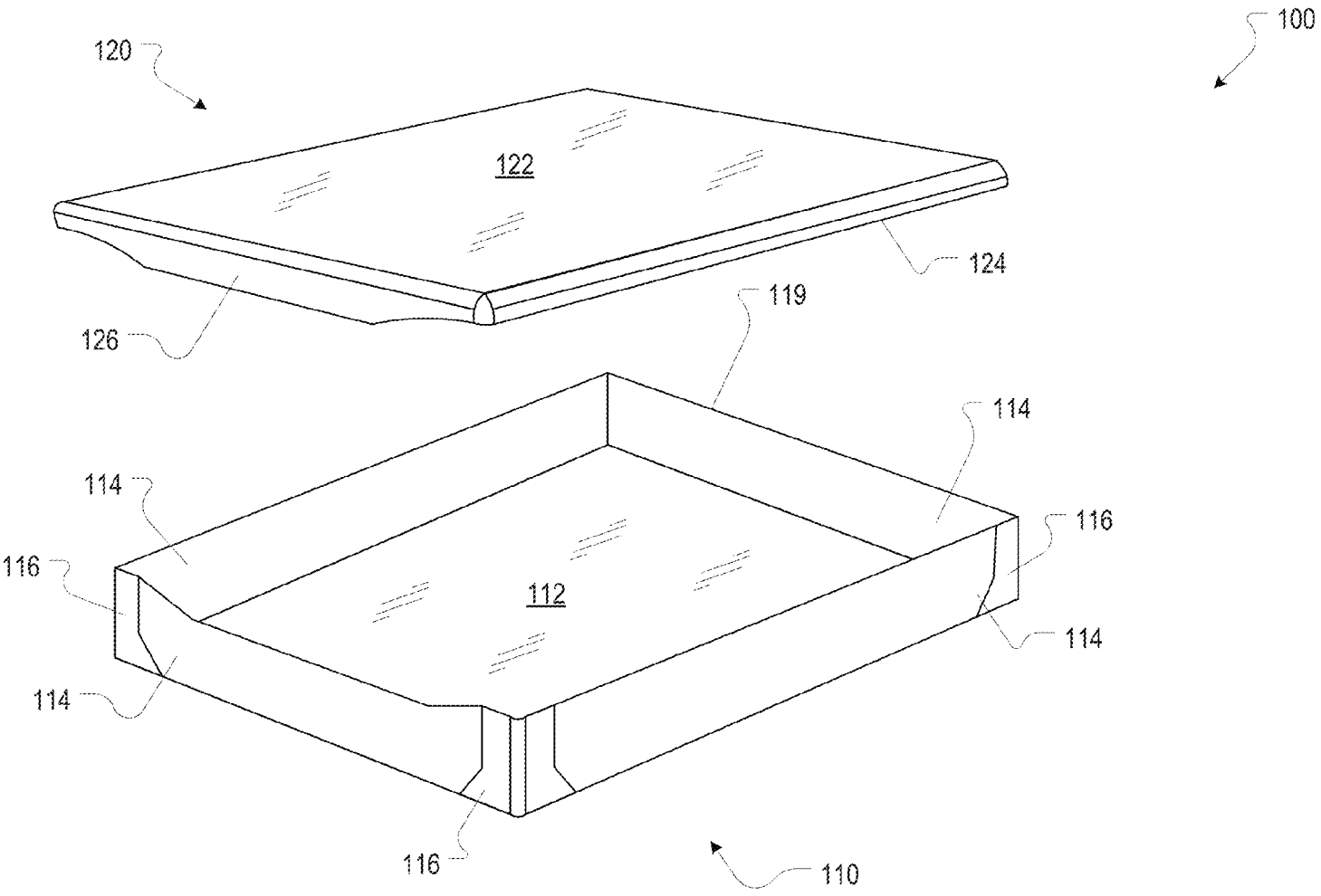
FIG. 2 illustrates a front perspective view of embodiments of a cover.

With respect to the cover 100, the cover can have any suitable shape and/or dimensions that allow it to enclose the other components of the mattress 10 and/or to serve as an outer layer of the mattress 10. Indeed, as shown in FIG. 2, at least in some embodiments, the cover 100 comprises a rectangular shape comprising the bottom cover portion 110 and the top cover portion 120. For example, the bottom cover portion 110 can comprise an extended bottom portion 112 and side portions 114 that extend from the extended bottom portion 112. The bottom cover portion 110 can also comprise one or more reinforced corners 116 configured to provide extra protection against wear for corner portions of the bottom cover portion 110. The side portions 114 can also be bordered by a bottom cover edge portion 119.

In some embodiments, the top cover portion 120 comprises an extended top portion 122. In some instances, the extended top portion 122 can be bordered by a top cover edge portion 124. The top cover edge portion 124 can also comprise one or more edge extensions 126. In other embodiments, the top cover portion 120 is configured to detachably and selectively couple to the bottom cover portion 110 along the top cover edge portion 124. The top cover edge portion 124 can detachably and selectively couple to the bottom cover portion 119 to connect the top cover portion 120 with the bottom cover portion 110. While the top cover edge portion 124 can detachably and selectively couple to the bottom cover portion 119 by any suitable means, at least in some embodiments, the top cover edge portion 124 can detachably and selectively couple to the bottom cover portion 119 with a zipper or similar fastener (e.g., buttons, clasps, hook and loop fasteners, grommets, hooks, straps, snaps, etc.). In yet other embodiments, the bottom cover portion 110 and/or bottom cover edge portion 119 can be configured to receive one or more of the edge extensions 126 from the top cover portion 120. For example, the bottom cover portion 110 and/or the bottom cover edge portion 119 can comprise a cutaway portion that corresponds to and/or receives the one or more edge extensions 126. In some cases, the top cover portion 120 can be detachably and selectively coupled to the bottom cover portion 110 with a first portion of a zipper that can be disposed along a perimeter of the top cover portion 120 with the first portion of the zipper configured to detachably and selectively couple with a second portion of a zipper that is disposed along a perimeter of the bottom cover portion 110.

In some embodiments, the cover 100 comprises any suitable material that allows it to function as intended. For example, the cover 100 can comprise any suitable textile, cloth, and/or fabric. The textile, cloth, and/or fabric can comprise one or more of any suitable natural or synthetic material such as eucalyptus fiber, wool, leather, silk, cashmere, mohair, angora, cotton, flax, bamboo fiber, hemp, polyester, armid fiber, acrylic, nylon, spandex, polyurethane, olefin fiber, polylactide fiber, and other similar materials. In other embodiments, the cover 100 comprises moisture wicking synthetic fabric and/or microfibers configured to wick moisture. In yet other embodiments, the cover 100 comprises other reinforcing materials such as webbing, sheeting, interface, netting, cording, and other similar materials that can be made from natural and/or synthetic materials. In other embodiments, the cover 100 comprises one or more of padding, cushioning, upholstery, and handles. In yet other embodiments, the cover 100 is configured to be easily removed and machine-washed by the user.

Figure 3A:
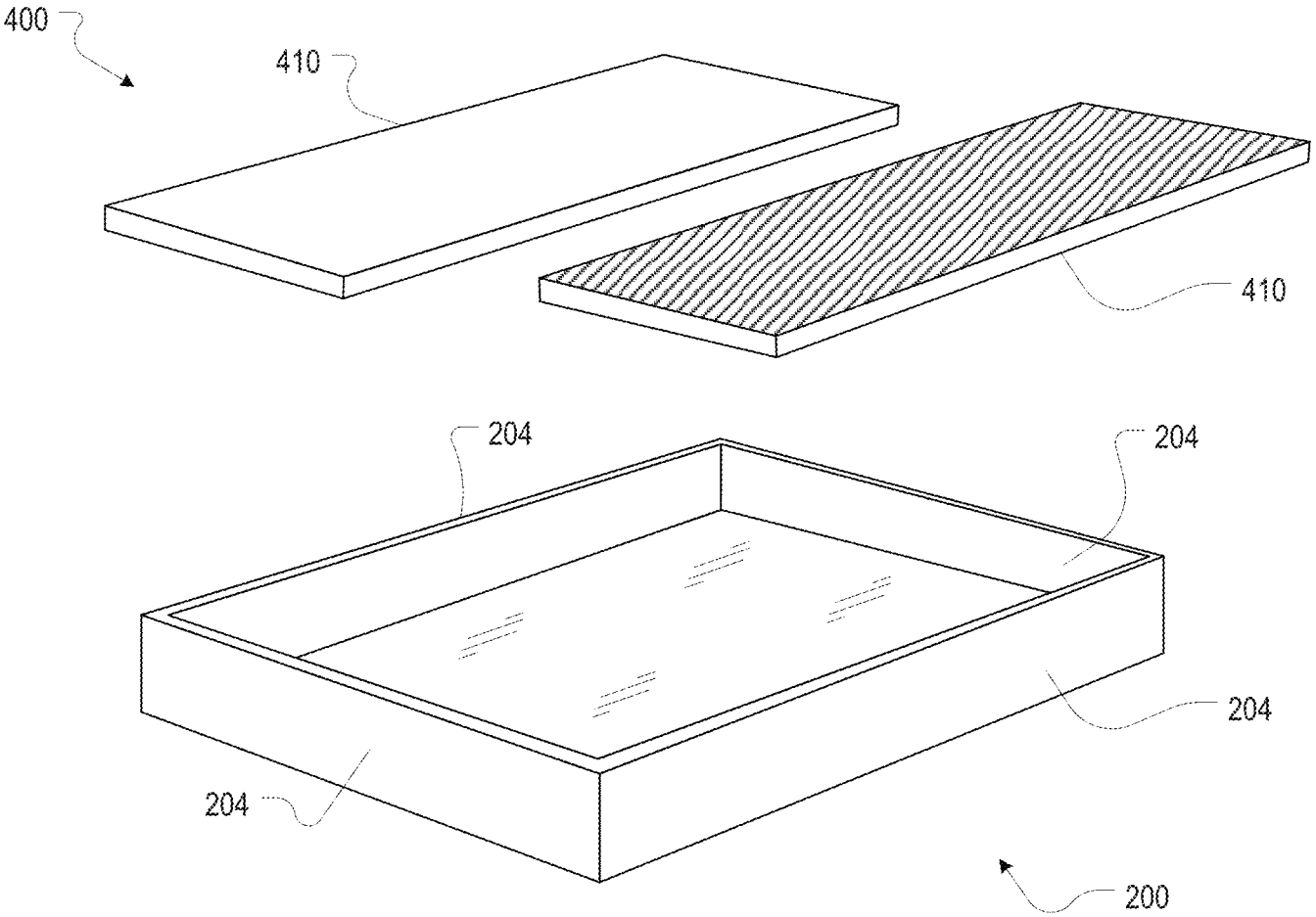
FIG. 3A illustrates a front perspective view of embodiments of a base and a comfort layer.

Referring now to FIG. 3A, embodiments of the base 200 are shown. While the base 200 can have any suitable shape and/or dimensions that allow it to contain the supporting layer 300, at least in some embodiments, it comprises a rectangular shape. Indeed, as shown in FIG. 3A, at least in some embodiments, the base 200 comprises a rectangular shape comprising a base bottom 202 and base sides 204 that extend upward from the base bottom 202.

Figure 4:
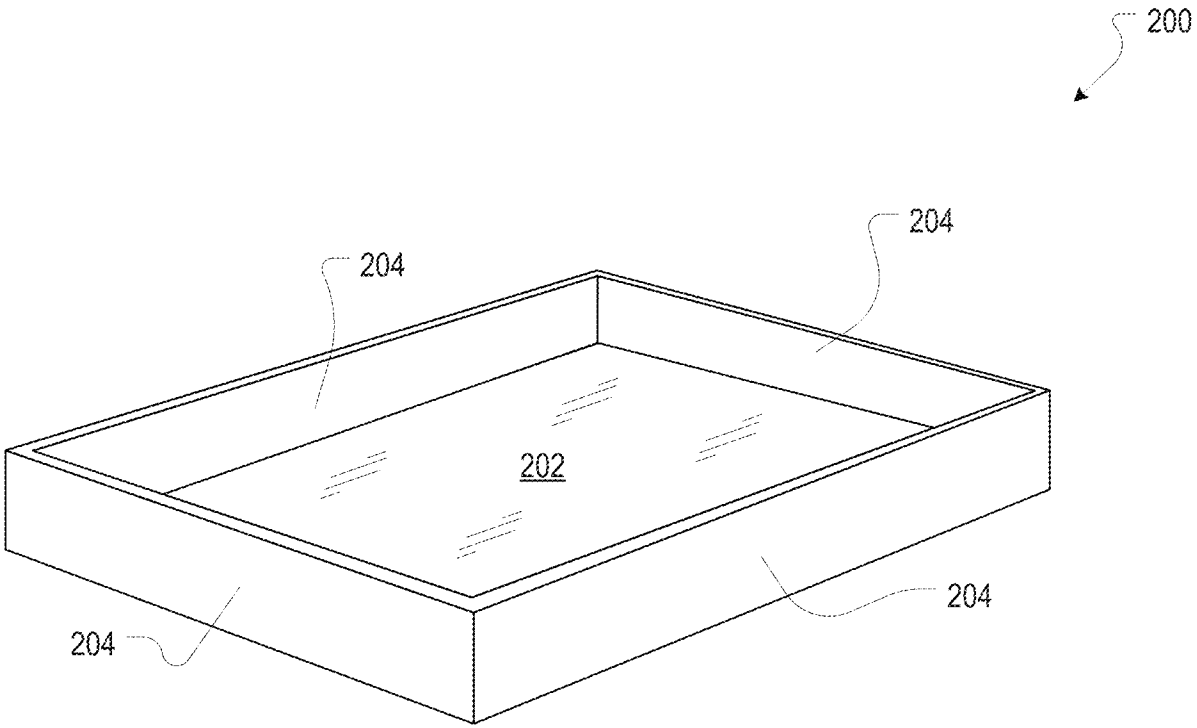
FIG. 4 illustrates a front perspective view of embodiments of a base with base vents.

Referring now to FIG. 4, in some embodiments, the base 200 comprises any suitable material that allows it to function as intended. For example, the base 200 can comprise one or more of a natural material such as rubber and/or a synthetic material. The base 200 can be configured to be rigid or semi-rigid. In some cases, the base 200 can be configured to be sufficiently rigid to provide edge support to the mattress 10, but not so rigid as to be uncomfortable to the user. For example, the base 200 can comprise an open-cell foam which can be configured to contain the supporting layer 300, provide edge support, and not be so rigid as to be uncomfortable to the user.

Returning to FIG. 3A, some embodiments of the comfort layer 400 are illustrated. While the comfort layer 400 can be configured in any suitable manner, at least in some embodiments, it comprises one or more temperature comfort pads 410. In some cases, the comfort layer 400 can comprise two rectangular temperature comfort pads 410 that are configured to be positioned side-by-side to provide two individual temperature comfort preference zones. For example, a first temperature comfort pad 410 can provide an individual temperature comfort preference zone to a first user on a left side of the mattress 10 and a second temperature comfort pad 410 can provide an individual temperature comfort preference zone to a second user on a right side of the mattress 10. In other cases, the comfort layer 400 can comprise a plurality of temperature comfort pads 410 to provide multiple temperature comfort preference zones to each user. For example, one temperature comfort pad 410 can provide a cool comfort side 420 to a head portion of a user's side, another temperature comfort pad 410 can provide a warm comfort side 430 to a midsection portion of the user's side, and yet another temperature comfort pad 410 can provide a cool comfort side 420 to a foot portion of the user's side.

While the temperature comfort pad 410 can comprise any suitable material that allows it to function as intended, at least in some embodiments, the temperature comfort pad 410 comprises viscoelastic polyurethane foam such as memory foam (e.g., low-resilience polyurethane foam and/or higher-density memory foam). In some cases, the temperature comfort pad 410 comprises a sheet of memory foam between about 1 and 4 inches. In other cases, the temperature comfort pad 410 comprises a sheet of memory foam of about 2 inches thickness. In yet other cases, the temperature comfort pad 410 comprises one or more of latex foam, foam rubber, polyurethane foam, reticulated foam, open-cell-structured foams, closed-cell foams, sandwich-structured composite materials, and other similar materials.

In some embodiments, the temperature comfort pad 410 comprises the cool comfort side 420 that is configured to feel cool to the touch and to feel cool to the user when the user lays on it and the warm comfort side 430 that is configured to feel warm to the touch and to feel warm when the user lays on it. In some cases, the cool comfort side 420 can comprise a dual-layer fabric that feels cool to the touch. In other cases, the cool comfort side can comprise a moisture wicking fabric or material configured to feel cool to the user when the user lays on it. In yet other cases, the cool comfort side 420 can comprise ceramic materials configured to absorb heat from the user. For example, the cool comfort side 420 can comprise fabric materials with embedded ceramic materials configured to absorb infrared radiation (e.g., heat) from the user. The cool comfort side 420 can comprise ceramic materials that absorb far infrared radiation (e.g., fine-grained mica such as sericite mineral, FIR (far infrared) emitting ceramic nanoparticles, or fabrics with incorporated FIR emitting ceramic nanoparticles). In some instances, the warm comfort side 430 can comprise ceramic materials configured to reflect heat back to the user. For example, the warm comfort side 430 can comprise fabric materials with embedded ceramic materials configured to reflect infrared radiation (e.g., heat) back to the user. The warm comfort side 430 can also comprise ceramic materials configured to radiate infrared radiation. The warm comfort side 430 can comprise ceramic materials that radiate far infrared radiation (e.g., fine-grained mica such as sericite mineral, FIR absorbing, emitting, or reflecting ceramic nanoparticles, or fabrics with incorporated FIR absorbing, emitting, or reflecting ceramic nanoparticles).

Figure 3B:
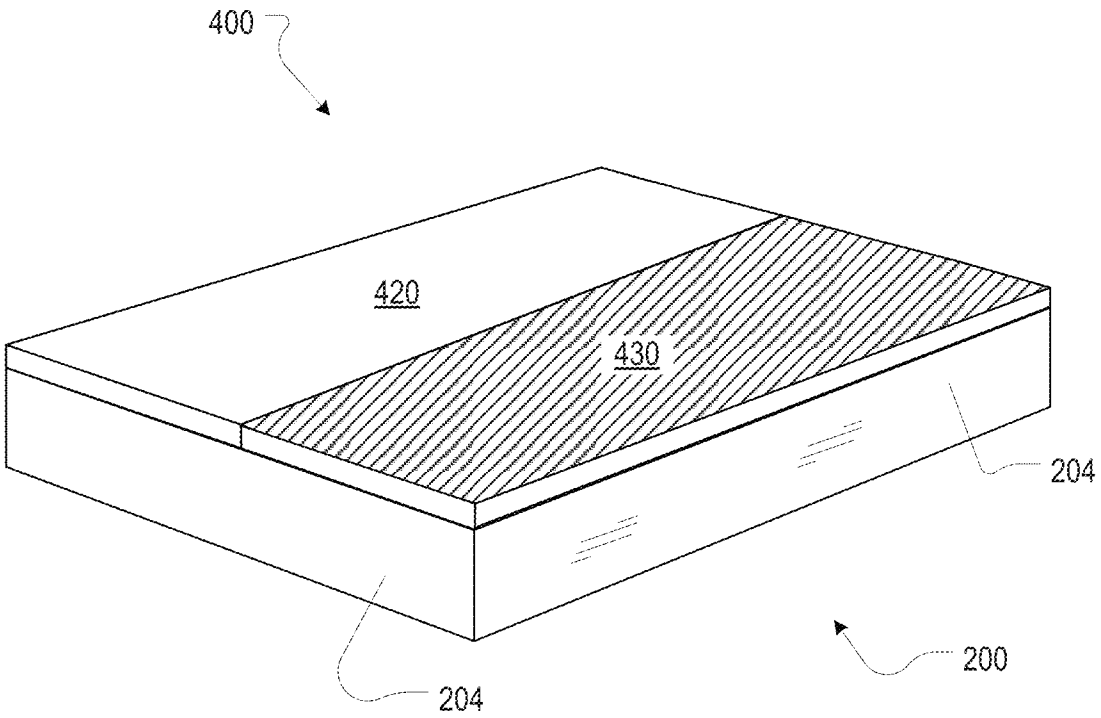
FIG. 3B illustrates a front perspective view of embodiments of a comfort layer selectively and reversibly coupled to a base.

Referring now to FIG. 3B, in some embodiments, one or more of the temperature comfort pads 410 is configured to selectively and reversibly couple with the base 200. The temperature comfort pads can be configured in any suitable manner to selectively and reversibly couple with the base 200. In some cases, the temperature comfort pad 410 can selectively and reversibly couple with the base 200 with one or more of tongue-and-groove connections, dove-tailed connections, interlocking teeth, interdigitating fingers, pins, slots, fasteners, couplings, hook and loop fasteners, and any other suitable connector.

Figure 5:
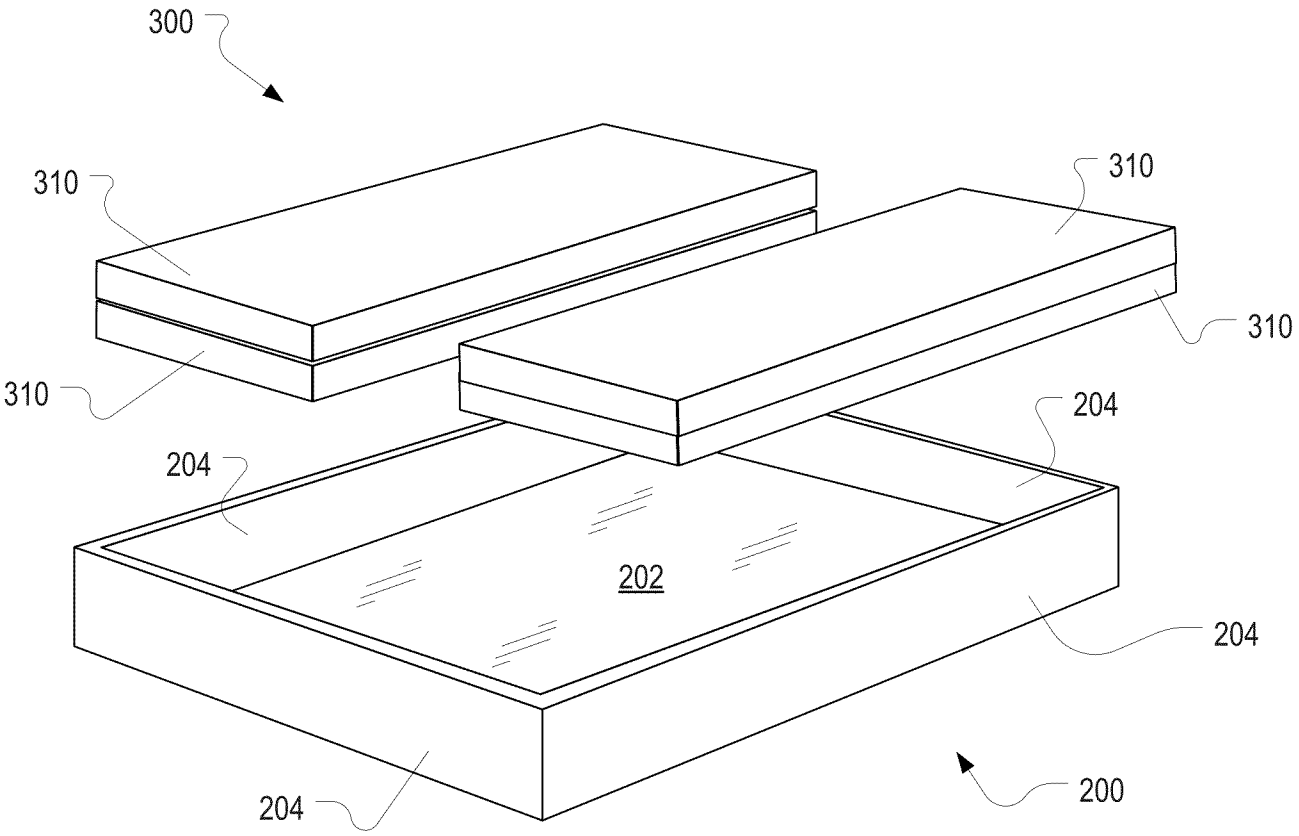
FIG. 5 illustrates a front perspective view of embodiments of a base and a supporting layer.

Referring now to FIG. 5, in some embodiments, the mattress 10 comprises a supporting layer 300 configured to fit within the base 200 and to provide support to the mattress 10 and/or to a reclining user. The supporting layer 300 can comprise one or more support pads 310. In some cases, the supporting layer 300 can comprise rectangular support pads 310 configured to be positioned side-by-side to provide two individual support preference zones. In other cases, support pads 310 are configured to be interchangeable. For example, the support pads 310 can be interchanged from a left positon, a right position, a top position, and/or a bottom position. Thus, in some instances, the support pads 310 can be interchanged from position to position to suit the user's preferences for firmness. In yet other cases, the supporting layer 300 can comprise one or more rectangular support pads 310 configured to be positioned side-by-side and/or configured to be layered and/or stacked to provide two individual support preference zones. For example, the support pads 310 can be configured to provide a first support preference to a first user and a second support preference to a second user. Each individual user can combine support pads of varying firmness to achieve a preferred support preference (e.g., the user can insert support pads 310 of medium firmness to achieve a preferred medium firmness and/or the user can insert support pads 310 of soft firmness to achieve a preferred soft firmness). In yet other cases, the support pads 310 can be configured to provide varying support preference zones to different portions of the reclining user. For example, the support pads 310 can be configured to provide soft support to the reclining user's head area and firm support to the reclining user's lower back area.

In some embodiments, the support pads 310 comprise different firmness and/or support levels. In some cases, a firmness level scale of 1 to 12 can be used to describe the firmness and/or support of the support pads 310, with a firmness level of 1 representing the softest feeling and a firmness level of 12 representing the firmest feeling. In other cases, two stacked support pads 310 can be used to achieve a preferred firmness. For example, two stacked support pads 310 of firmness scale levels of 6 and 8 can be used. The user can place the support pad 310 with the firmness level 6 in the upper position and firmness level 8 in the bottom position to get a softer feeling sleep experience. Likewise, the user can place the support pad 310 with the firmness level 8 in the upper position and the firmness level 6 in the bottom position to get a firmer feeling sleep experience. Similarly, the user can use support pads 310 of firmness 2 and 4 for a softer feeling sleep experience. Additionally, the user can use support pads 310 of firmness scale levels of 10 and 12 to achieve a firmer feeling sleep experience. Therefore, a user can use any combination of support pads 310 of firmness scale levels between 1 and 12 to achieve a preferred firmness and/or support level.

In some embodiments, the supporting layer 300 comprises any suitable material configured to provide support to the mattress 10 and/or to a reclining user. For example, the support pads 310 can comprise one or more of a polyurethane, a latex foam, a high resilience polyurethane foam (e.g., EvoPore High Resilience Climate™), a viscoelastic polyurethane foam such as memory foam (e.g., low-resilience polyurethane foam and/or higher-density memory foam). In some cases, the support pad 310 comprises a sheet of memory foam between about 0.5 and 6 inches. In other cases, the support pad 310 comprises a sheet of memory foam of about 3 inches thickness. In yet other cases, the support pad 310 comprises one or more of foam rubber, polyurethane foam, reticulated foam, open-cell-structured foams, closed-cell foams, sandwich-structured composite materials, and other similar materials. In other embodiments, the support pads 310 comprise one or more of animal hair, feathers, down, straw, cotton, egg-crate foam, polyurethane foam, latex foam, felt, polyester fiber, cotton fiber, wool fiber, plant fiber, and nonwoven fiber pads.

Figure 6A:
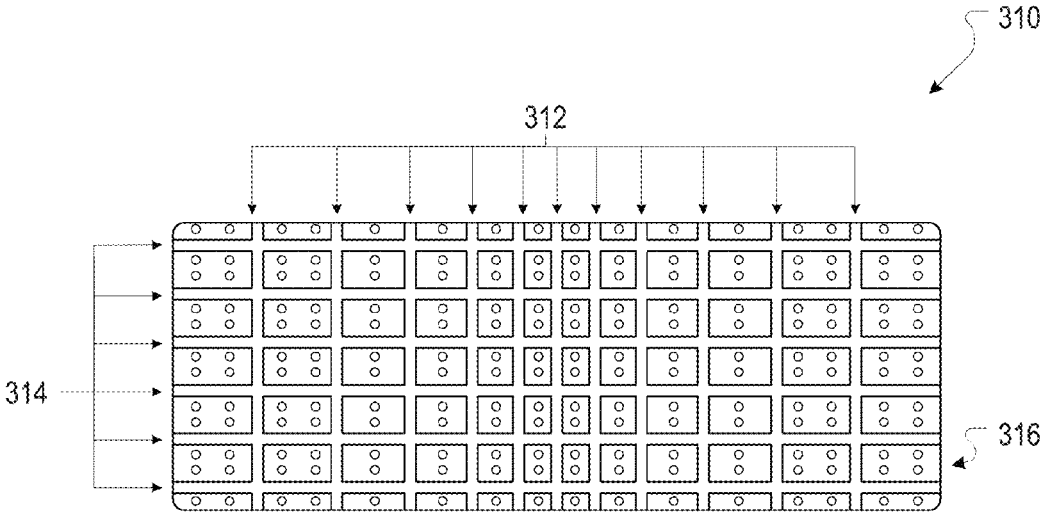
FIG. 6A illustrates a top view of embodiments of a support pad.

Referring now to FIG. 6A, a top view of the support pad 310 is shown. While the support pad 310 can comprise any shape or configuration that allows it to function as intended, at least in some embodiments, the support pad 310 comprises one or more channels configured to allow passage of air, heat, and/or moisture between the mattress 10 and the surrounding environment. The one or more channels can be configured in any suitable manner, can be at any depth, can be at any spacing, and can be at any orientation with respect to the support pad 310. In some cases, the channels comprise one or more short channels 312 that traverse a width of the supporting pad 310 on a top surface of the support pad 310. In other cases, the channels comprise one or more long channels 314 that traverse a length of the supporting pad 310 on the top surface of the support pad 310. In some embodiments, the support pad 310 comprises a crisscross pattern of channels comprising short channels 312 and long channels 314. In other embodiments, the short channels 312 are disposed on the support pad 310 such that a larger number of short channels 312 are disposed on a middle portion of the support pad 310 and a lesser number of short channels 312 are disposed on the end portions of the support pad 310. In yet other embodiments, the long channels 314 are disposed on the support pad 310 such that a larger number of long channels 314 are disposed on a middle portion of the support pad 310 and a lesser number of long channels 314 are disposed on the end portions of the support pad 310.

In some embodiments, the one or more channels are configured in any suitable shape that allows it to function as intended. For example, in some cases, the channels can be configured as straight linear channels that run parallel to one or more of the length and/or width of the support pad 310. In other cases, the channels can be configured as linear channels that run diagonal to one or more of the length and/or width of the support pad 310. In yet other cases, one or more of the short channels 312 and one or more of the long channels 314 can be configured to intersect at right angles. In some instances, one or more of the short channels 312 and one or more of the long channels 314 can be configured to intersect at angles other than right angles. In other instances, the channels can be configured as curved lines on the support pad 310. For example, the channels can be configured as curved lines that traverse at least a portion of the support pad 310. In yet other instances, the channels can be configured as curved lines that intersect as they traverse at least a portion of the support pad 310. In some cases, the channels can be configured to be circular. In other cases, the channels can be configured to be semicircular. In yet other cases, the channels can be configured to be circular and arranged in at least a partially concentric configuration.

In some embodiments, the support pad 310 comprises about 1 to about 20 short channels 312. For example, the support pad 310 can comprise about 1, 2, 3, 4, 5, 6, 7, 8, 9, 10, 11, 12, 13, 14, 15, 16, 17, 18, 19, or 20 short channels 312. In other embodiments, the support pad 310 comprises about 1 to about 20 long channels 314. For example, the support pad 310 can comprise about 1, 2, 3, 4, 5, 6, 7, 8, 9, 10, 11, 12, 13, 14, 15, 16, 17, 18, 19, or 20 long channels 314. In yet other embodiments, the short channels 312 and/or the long channels 314 are between about 0.1 and about 3 inches deep. For example, the short channels 312 and/or the long channels 314 can be about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0 inches deep. In some embodiments, the short channels 312 and/or the long channels 314 are between about 0.1 and about 3 inches wide. For example, the channels can be about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0 inches wide.

In some embodiments, the support pad 310 comprises one or more vertical holes 316. In other embodiments, the vertical holes 316 are configured to allow passage of air, heat, and/or moisture between the mattress 10 and the surrounding environment. In some cases, one or more of the vertical holes 316 can be configured to completely traverse the support pad 310. In other cases, one or more of the vertical holes 316 can be configured to only partially traverse the support pad 310. In some instances, one or more of the vertical holes 316 can be disposed within a short channel 312. In other instances, one or more to the vertical holes 316 can be disposed within a long channel 314. In yet other instances, one or more of the vertical holes 316 can be disposed at an intersection of a short channel 312 and a long channel 314.

Figure 6B:
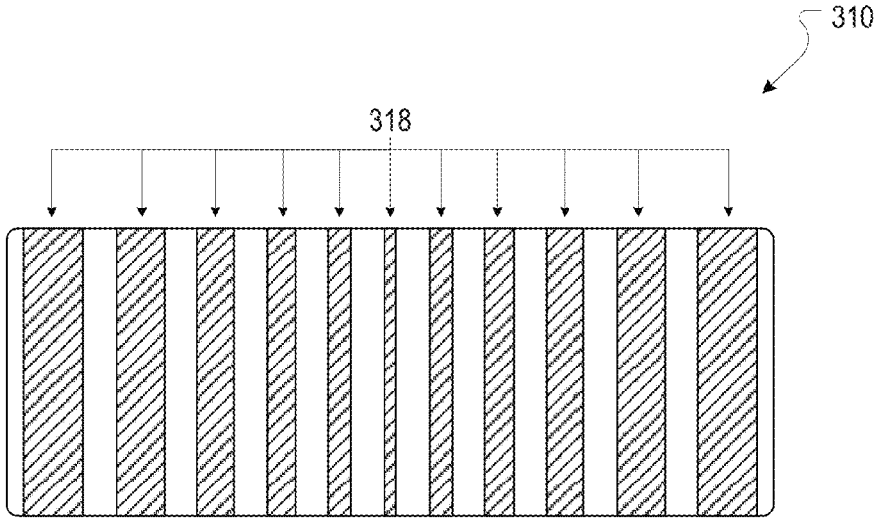
FIG. 6B illustrates a bottom view of embodiments of a support pad.

Referring now to FIG. 6B, a bottom view of the support pad 310 is shown. In some embodiments, the support pad 310 comprises one or more ventilation channels 318 that traverse a bottom surface of the support pad 310. The ventilation channels 318 can be configured to allow passage of air, heat, and/or moisture between the mattress 10 and the surrounding environment. In some cases, the ventilation channels 318 can be configured to traverse the width of the support pad 310. In other cases, the ventilation channels 318 can be configured to traverse the length of the support pad 310. In yet other cases, the ventilations channels 318 can be disposed on the support pad 310 such that a larger number of ventilation channels 318 are disposed on the middle portion of the support pad 310 and a lesser number of ventilation channels 318 are disposed on the end portions of the support pad 310. In some instances, the ventilation channels 318 can be configured to vary in width over the bottom surface of the support pad. For example, the ventilations channels 318 located at the middle portion of the support pad 310 can be relatively narrow in width. The ventilation channels 318 at the end portions of the support pad 310 can relatively wide in width. Likewise, the ventilations channels 318 located at the middle portion of the support pad 310 can be relatively wide in width. The ventilation channels 318 at the end portions of the support pad 310 can relatively narrow in width.

Figure 6C:
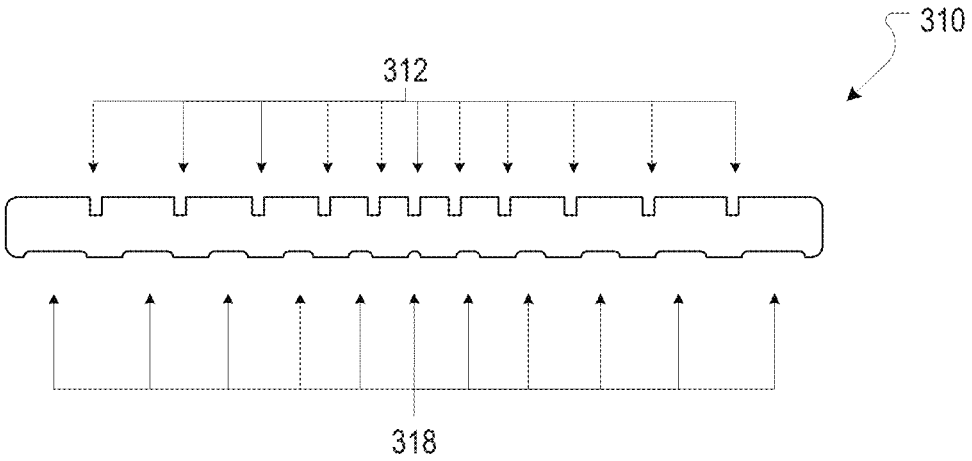
FIG. 6C illustrates a side view of embodiments of a support pad.
Figure 6D:
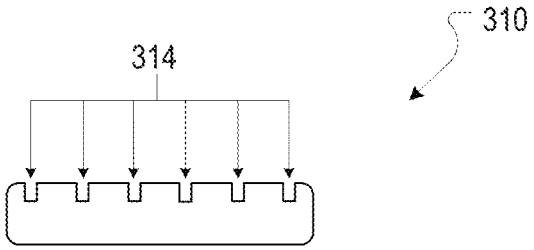
FIG. 6D illustrates an end view of embodiments of a support pad.

Referring now to FIG. 6C, a side view of some embodiments of the support pad 310 is shown. In some embodiments, the support pad 310 comprises short channels 312 and long channels 314 disposed on the top surface of the support pad 310 and/or ventilation channels 318 disposed on the bottom surface of the support pad 310. FIG. 6D shows an end view of some embodiments of the support pad 310. In some embodiments, the long channels 314 are seen in an end view of the support pad 310.

Figure 6E:
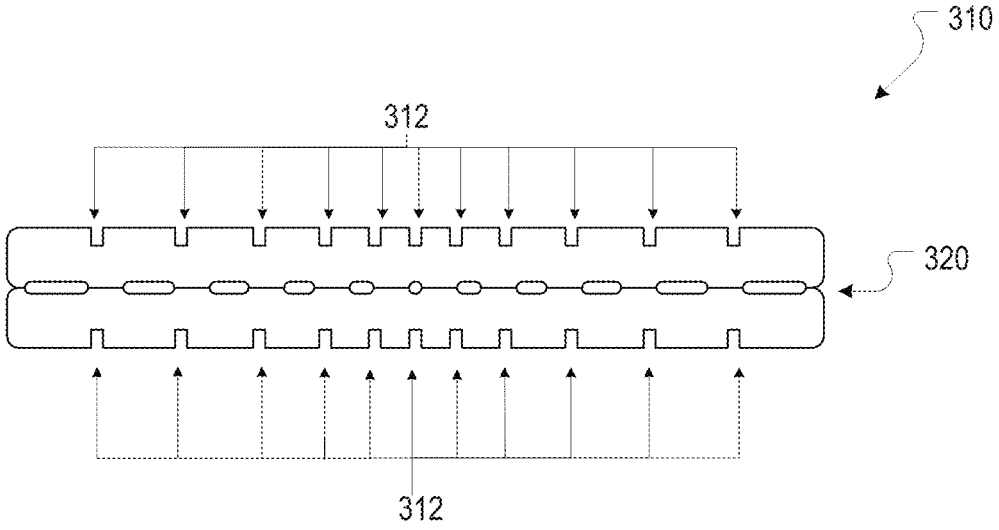
FIG. 6E illustrates a side view of embodiments of two stacked support pads.
Figure 6F:
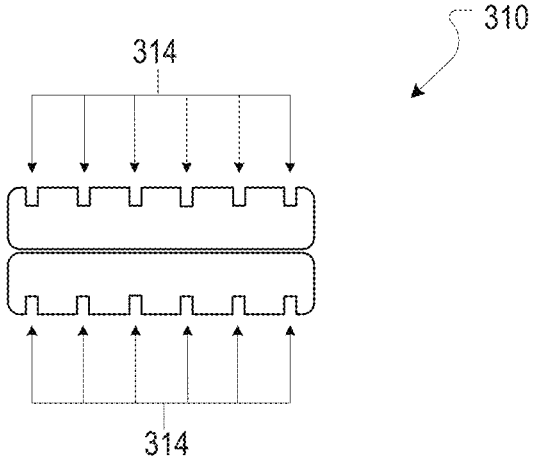
FIG. 6F illustrates an end view of embodiments of two stacked support pads.

Referring now to FIGS. 6E and 6F, some embodiments of the support layer 300 are illustrated. FIGS. 6E and 6F show side and end views of the support layer 300, respectively. At least in some embodiments, the support layer 300 comprises two support pads 310 that are stacked such that the bottom surfaces of each support pad 310 are facing one another. In some cases, the two support pads 310 are stacked such that the bottom surfaces of each support pad 310 are facing one another and the respective ventilation channels 318 are aligned. The aligned ventilation channels 318 can be configured to align and/or overlap to form ventilation passageways 320. The ventilation passageways 320 can be configured to allow passage of air, heat, and/or moisture from the mattress 10 to the surrounding environment. The ventilation passageway 320 can also be configured to allow passage of fresh air, cool air, and/or warm air to the mattress 10.

In some embodiments, one or more of the short channels 312, long channels 314, vertical holes 316, ventilation channels 318, and/or ventilation passageways 320 are aligned with other vents. For example, a ventilation channel 320 can be aligned with one or more of a vertical hole 316, and another vent to allow passage of air, heat, and/or moisture from the mattress 10 to the surrounding environment. The aligned ventilation channel 320, vertical holes 316, and another vent can also allow passage of fresh air, cool air, and/or warm air to the mattress 10.

In some embodiments, the supporting layer 300 comprises any other suitable component that allows it to function as intended. Some examples of suitable components include one or more valves such as check-valves or pressure valves. In some cases, valves such as check valves can be used to create a bellows-like action in which air flow is controlled to allow warm and/or moisture-laden air to be expelled from the mattress 10 and cool dry air to be drawn into the mattress. The movement of the user as he or she sleeps can activate the bellows-like action to allow warm and/or moisture-laden air to be expelled from the mattress 10 and cool dry air to be drawn into the mattress. Suitable components can also include one or more baffles, vanes, and panels to allow for effective distribution of air and/or heat. In some instances, the one or more baffles, vanes, and panels can be disposed in one or more of the short channels 312, long channels 314, vertical holes 316, ventilation channels 318, and/or ventilation passageways 320.

In some embodiments, the mattress 10 is configured to provide a comfortable environment for the user during sleep. For example, the mattress 10 can be configured to permit passage of one or more of air, heat, and moisture from the user through the mattress and into the surrounding environment. For example, the vertical holes 316 can be configured to permit passage of one or more of air, heat, and moisture from the user through the mattress and into the surrounding environment. The vertical holes 316 can be configured to draw away one or more of air, heat, and moisture from the user as the user reclines on the mattress 10. The vertical holes 316 can also be configured to transport one or more of air, heat, and moisture from the user and transfer the one or more of air, heat, and moisture through one or more of the aligned ventilation channel 320, and other vents to the surrounding environment. Likewise, the vertical holes 316 can be configured to allow passage of one or more of fresh air, cool air, warm air, and dry air to the user as the user reclines on the mattress 10. For example, the one or more of fresh air, cool air, warm air, and dry air can be transferred from the surrounding environment through one or more of aligned ventilation channel 320 and other vents to the vertical holes 316 and to the reclining user.

In some embodiments, one or more of the cover 100, the base 200, the support pads 310, and the temperature comfort pads 410 comprise an outer layer configured to reduce friction. In other embodiments, one or more of the cover 100, the base 200, the support pads 310, and the temperature comfort pads 410 comprise and outer layer to reduce friction to allow the user to easily assemble and/or disassemble the various components of the modular multi-component mattress 10. The cover 100, the base 200, the support pads 310, and the temperature comfort pads 410 can be covered with a material that reduces friction (e.g., a satiny textile, a foil covering, or a plastic covering) and/or allows for components to easily slide against one another to ease assembly and disassembly.

Figure 7A:
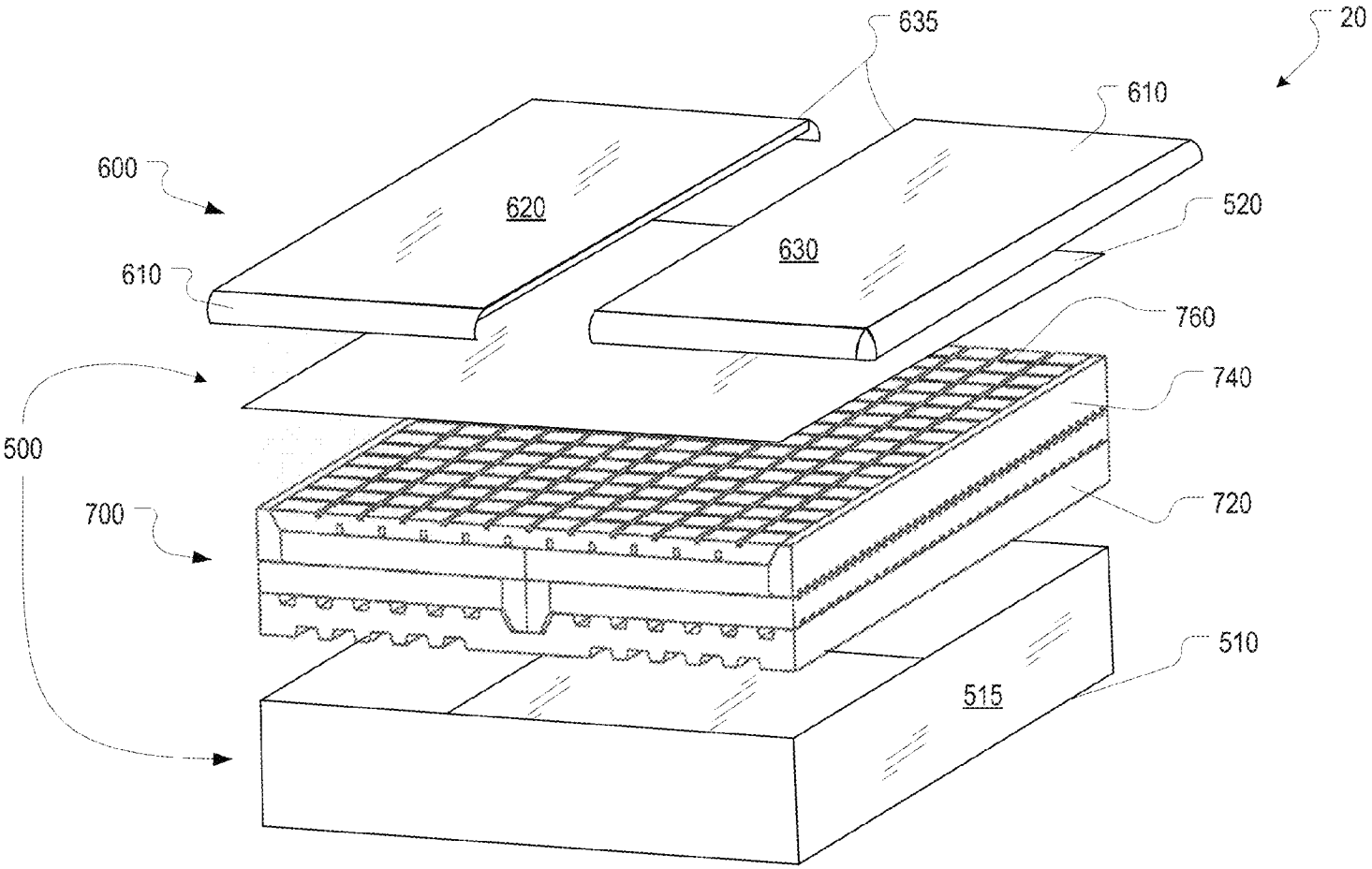
FIG. 7A illustrates a front perspective view of embodiments of a modular multi-component mattress.

Referring now to FIG. 7A, embodiments of a mattress assembly 20 are illustrated. FIG. 7A shows that at least in some embodiments, the mattress assembly 20 comprises one or more of a cover assembly 500, a topper layer 600, and a mattress core 700. Additionally, the mattress assembly 20 can comprise one or more components described above in mattress 10. Likewise, mattress 10 can comprise one or more components described for mattress assembly 20. In some embodiments, the cover assembly 500 is configured to enclose the mattress core 700 and/or to function as an outer layer of the mattress assembly 20. The cover assembly 500 can comprise more than one section and can be opened and closed to facilitate insertion, removal, assembly, disassembly, reassembly, and/or adjustment of the mattress core 700. The topper layer 600 can be configured to cover the cover 500 and/or the mattress core 700 and to provide a temperature comfort preference to the user. The mattress core 700 can be configured to provide support and/or firmness to the user.

Figure 7B:
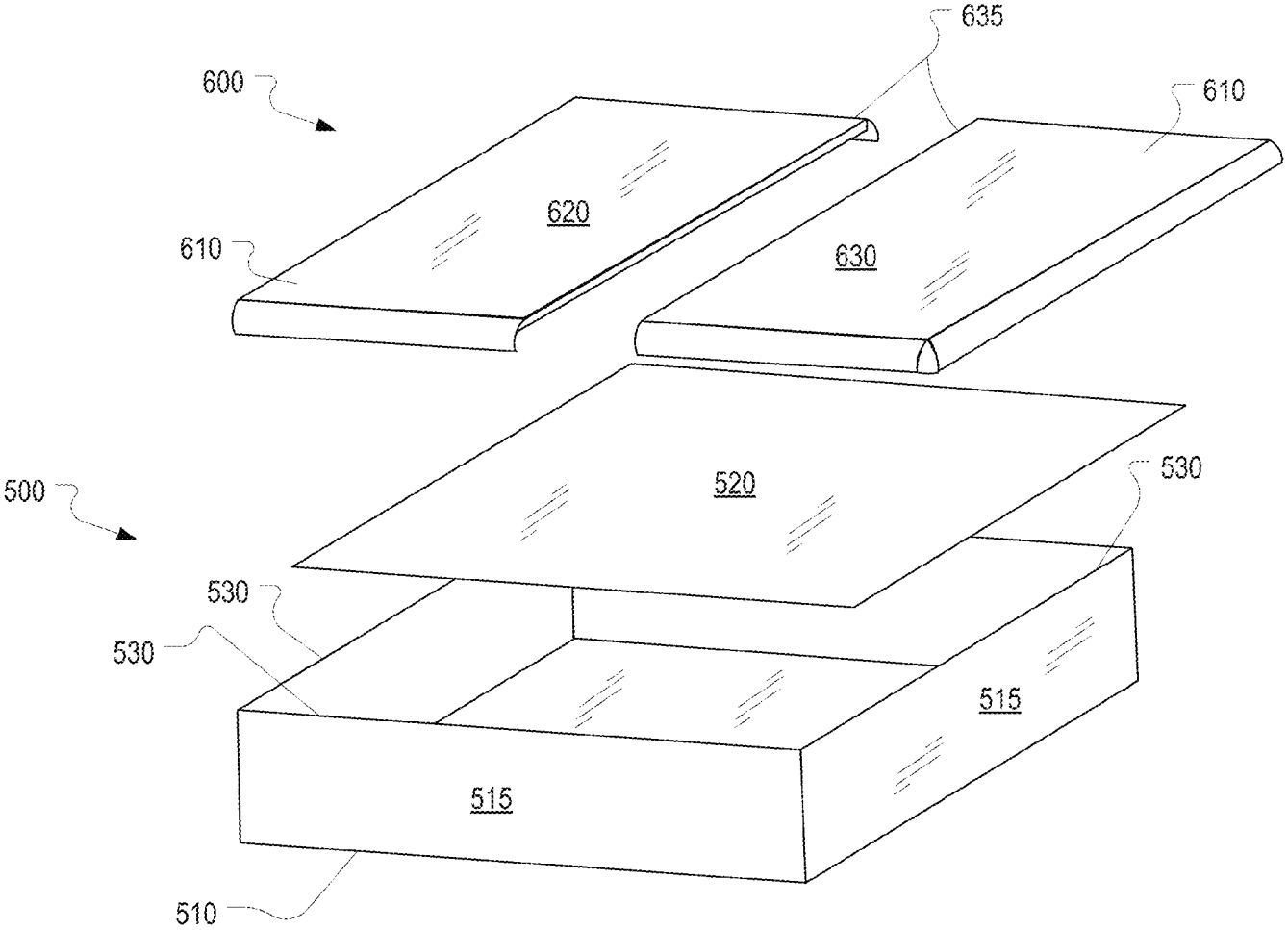
FIG. 7B illustrates a front perspective view of embodiments of a cover and a temperature topper pad.
Figure 7C:
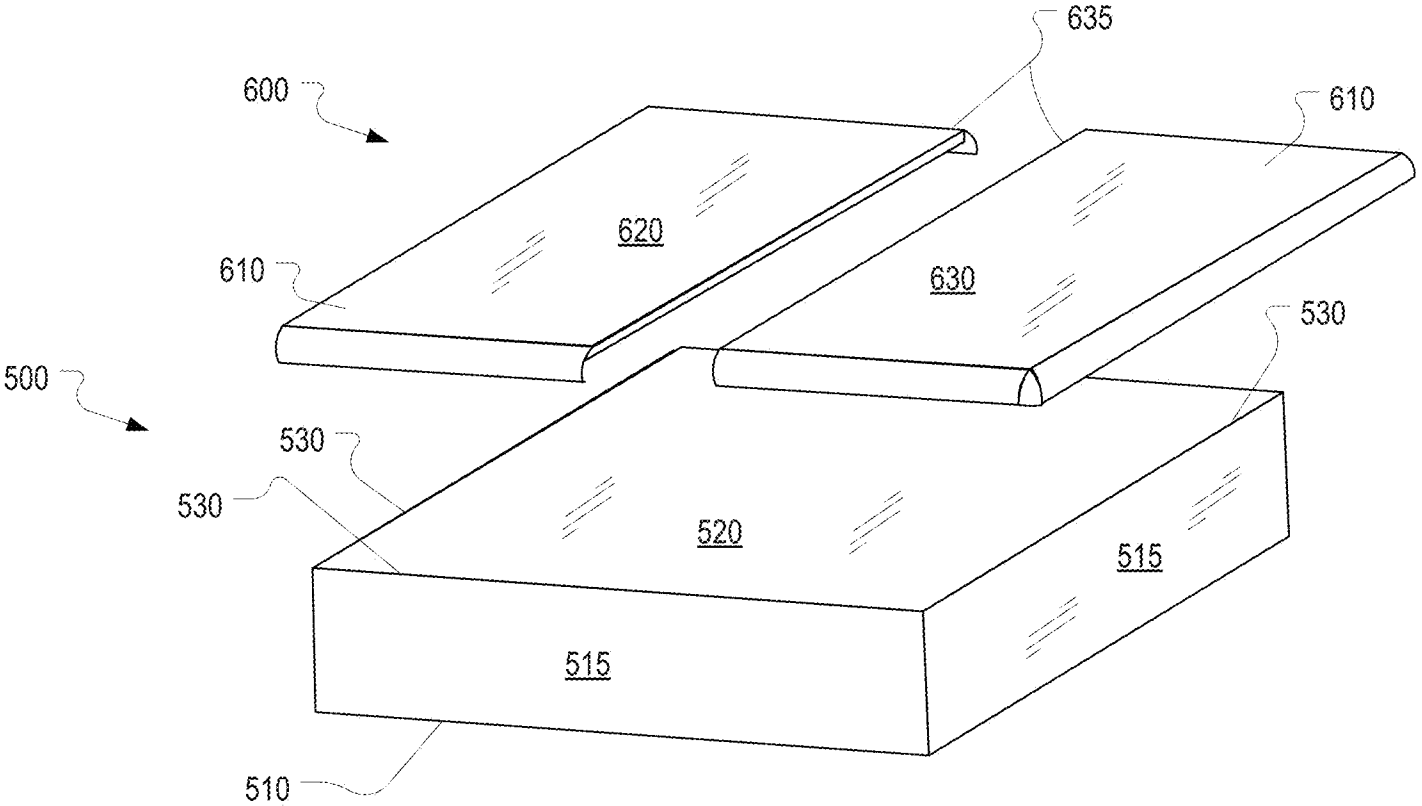
FIG. 7C illustrates a front perspective view of embodiments of a cover and a temperature topper pad.
Figure 7D:
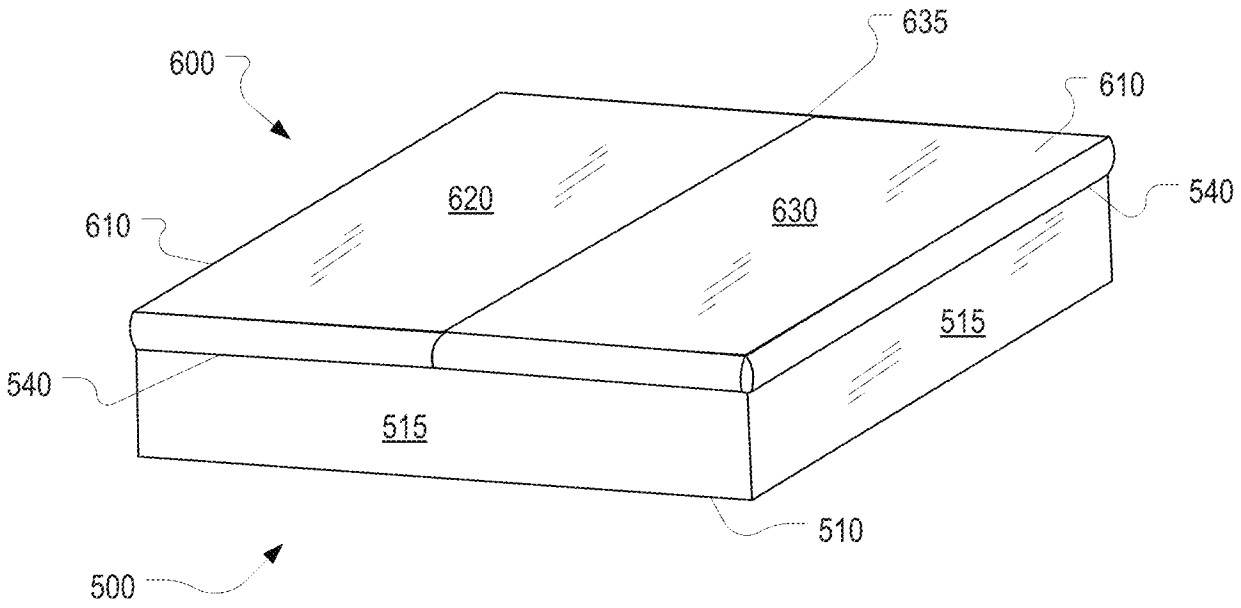
FIG. 7D illustrates a front perspective view of embodiments of a temperature topper pad fitted to a cover.
Figure 8:
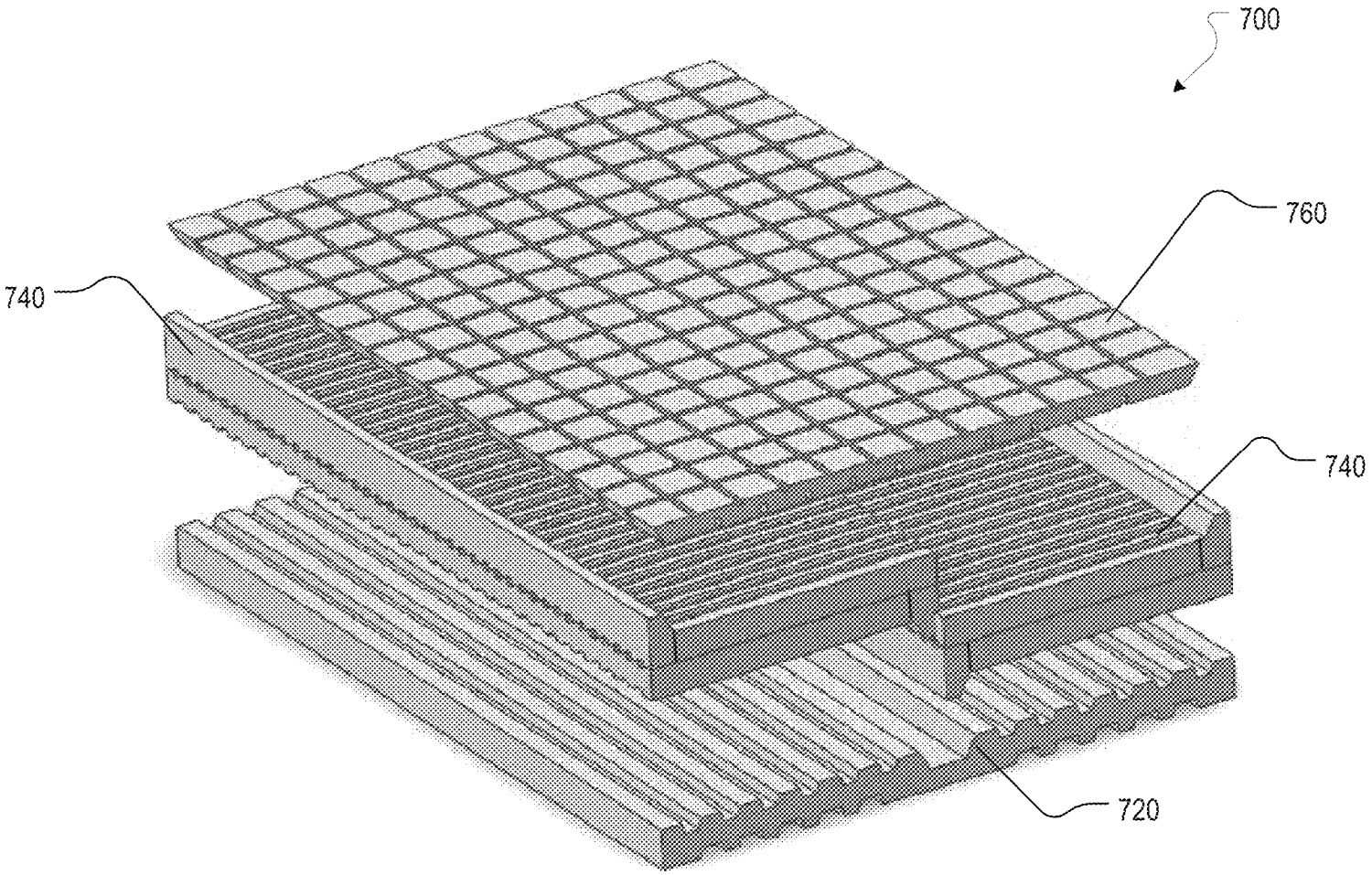
FIG. 8 illustrates a front perspective view of embodiments of a mattress core.

Referring now to FIGS. 7B, 7C, and 7D, embodiments of a cover assembly 500 and a topper layer 600 are shown. With respect to the cover assembly 500, it can have any suitable shape and/or dimension that allow it to contain one or more of mattress components. For example, the cover assembly 500 can be configured to cover and/or contain one or more of the base 200, the supporting layer 300, and the comfort layer 400. The cover assembly 500 can also be configured to cover and/or contain the base 200 and the supporting layer 300. Indeed, as shown in FIGS. 7B, 7C, and 7D, at least in some embodiments the cover assembly 500 comprises a rectangular shape comprising a bottom cover assembly portion 510 and a top cover assembly portion 520. In some cases, the bottom cover assembly portion 510 can comprise a flat bottom portion and side portions that extend from the flat bottom portion. The flat bottom portion can comprise one or more reinforced corners and vents. The vents can be disposed along the flat bottom portion and/or the side portion. In other cases, the top cover assembly portion 520 can be configured to detachably and selectively couple to the bottom cover assembly portion 510. In yet other cases, the top cover assembly portion 520 can comprise a flat top portion and side portions that extend from the flat top portion. The top cover assembly portion 520 can comprise one or more reinforced corners and vents.

As shown in FIGS. 7B and 7C, while the top cover assembly portion 520 can detachably and selectively couple to the bottom cover assembly portion 510 by any suitable means, at least in some embodiments, the top cover assembly portion 520 detachably and selectively couples to the bottom cover assembly portion 510 at a seam 530 with a zipper or similar fastener (e.g., buttons, clasps, hook and loop fasteners, grommets, hooks, straps, snaps, etc.). For example, the top cover assembly portion 520 can be detachably and selectively coupled to the bottom cover assembly portion 510 at a seam 530 with a first portion of a zipper that can be disposed along a perimeter of the top cover assembly portion 520 with the first portion of the zipper configured to detachably and selectively couple with a second portion of a zipper that is disposed along a perimeter of the bottom cover assembly portion 510.

In some embodiments, the cover assembly 500 comprises any suitable material that allows it to function as intended. For example, the cover assembly 500 can comprise any suitable textile, cloth, foam, and/or fabric. The textile, cloth, and/or fabric can comprise one or more of any suitable natural or synthetic material such as wool, leather, silk, cashmere, mohair, angora, cotton, flax, bamboo fiber, hemp, polyester, armid fiber, acrylic, nylon, spandex, polyurethane, olefin fiber, polylactide fiber, and other similar materials. In other embodiments, the cover assembly 500 comprises moisture wicking synthetic fabric and/or microfibers configured to wick moisture. In yet other embodiments, the cover assembly 500 comprises other reinforcing materials such as webbing, sheeting, interface, netting, cording, foam rubber and other similar materials that can be made from natural and/or synthetic materials.

In some embodiments, the cover assembly 500 comprises reinforcing materials to give the cover assembly 500 support and/or shape. For example, the cover assembly 500 can comprise reinforcing materials in the bottom cover assembly portion 510 and/or the top cover assembly portion 520. The bottom cover assembly portion 510 and/or the top cover assembly portion 520 can comprise reinforcing materials such as foam rubber to give the components support and/or shape. For example, the bottom cover assembly portion 510 can comprise reinforcing materials around a side wall portion 515 to give shape and support to the bottom cover assembly portion 510. The side wall portion 515 can comprise one or more layers of reinforcing materials to give shape and support to the side wall portion 515. The reinforcing layers can prevent the side wall portion 515 from sagging and/or appearing slack. The reinforcing materials can comprise any suitable materials including foam rubber and other similar materials.

Referring now to FIGS. 7B, 7C, and 7D, embodiments of a topper layer 600 are shown. With respect to the topper layer 600, it can have any shape and/or dimension that allow it to cover a top portion of the mattress 10 at least in part. In some embodiments, the topper layer 600 is configured to provide a removable layer of bedding on top of the mattress 10. In other embodiments, the topper layer 600 is configured to provide an extra comfort layer on top of the mattress 10. In yet other embodiments, the topper layer 600 is configured to provide a temperature comfort layer on top of the mattress 10. In some cases, the topper layer 600 can be configured to detachably and selectively couple to the mattress 10. In other cases, the topper layer 600 can be configured to cover a top portion of the cover assembly 500. In yet other cases, the topper layer 600 can be configured to detachably and selectively couple to the cover assembly 500. For example, the topper layer 600 can detachably and selectively couple to the top cover assembly portion 520 with a zipper or similar fastener (e.g., buttons, clasps, hook and loop fasteners, grommets, hooks, straps, snaps, etc.) along a seam 540 (See FIG. 7D). In some instances, the topper layer 600 can comprise a gusset along an edge. The gusset can be configured to detachably and selectively couple to the mattress 10. The gusset can also be configured to detachably and selectively couple to the cover assembly 500 along a seam 540.

In some embodiments, the topper layer 600 comprises any suitable material that allows it to function as intended. For example, the topper layer 600 can comprise any suitable textile, cloth, foam, and/or fabric. The textile, cloth, and/or fabric can comprise one or more of any suitable natural or synthetic material such as wool, leather, silk, cashmere, mohair, angora, cotton, flax, bamboo fiber, hemp, polyester, armid fiber, acrylic, nylon, spandex, polyurethane, olefin fiber, polylactide fiber, and other similar materials. In other embodiments, the topper layer 600 comprises moisture wicking synthetic fabric and/or microfibers configured to wick moisture. In yet other embodiments, the topper layer 600 comprises other reinforcing materials such as webbing, sheeting, interface, netting, cording, and other similar materials that can be made from natural and/or synthetic materials.

Referring now to FIG. 7B, in some embodiments, the topper layer 600 comprises one or more temperature topper pads 610. While the temperature topper pad 610 can be configured in any suitable manner, at least in some embodiments, it comprises two rectangular temperature topper pads 610 that are configured to be positioned side-by-side to provide two individual temperature comfort preference zones. For example, a first temperature topper pad 620 can provide a first individual temperature comfort preference zone to a first user on a left side of the mattress 10 and a second temperature topper pad 630 can provide a second individual temperature comfort preference zone to a second user on a right side of the mattress 10. In other cases, the topper layer 600 can comprise a plurality of temperature topper pads 610 to provide multiple temperature comfort preference zones to each user. For example, one temperature topper pad 610 can provide a cool comfort side to a head portion of a user's side, another temperature topper pad can provide a warm comfort side to a midsection portion of the user's side, and yet another temperature topper pad can provide a cool comfort side to a foot portion of the user's side. In other embodiments, the temperature topper pad 610 is configured to be reversible, with one side configured to provide a cool comfort side and another side configured to provide a warm comfort side. In yet other embodiments, the topper layer 600 is configured to allow the user to arrange the configuration of one or more temperature topper pads 610. For example, the user can arrange the reversible temperature topper pads 610 to provide a first temperature comfort preference zone to a first user on a left side of the topper layer 600 and a second temperature comfort preference zone to a second user on a right side of the topper layer 600. In some cases, the first and second temperature topper pads 610 can be detachably and selectively coupled to each other along an interface 635 with any suitable fastener (e.g., zippers, buttons, clasps, hook and loop fasteners, grommets, hooks, straps, snaps, etc.).

In some embodiments, the topper layer 600 comprises any suitable configuration and/or component to allow it to function as intended. For example, the topper layer 600 can comprise one or more channels, vents, horizontal holes, vertical holes, meshing, ducting to allow it to provide an extra comfort layer and/or to provide a temperature comfort layer.

While the temperature topper pad 610 can comprise any suitable material that allows it to function as intended, at least in some embodiments, the temperature topper pad 610 comprises viscoelastic polyurethane foam such as memory foam (e.g., low-resilience polyurethane foam and/or higher-density memory foam). In some cases, the temperature topper pad 610 comprises a sheet of memory foam between about 0.5 and 3 inches. In other cases, the temperature topper pad 610 comprises a sheet of memory foam of about 1 inch thickness. In yet other cases, the temperature topper pad 610 comprises one or more of foam rubber, polyurethane foam, reticulated foam, open-cell-structured foams, closed-cell foams, sandwich-structured composite materials, and other similar materials.

In some embodiments, the temperature topper pad 610 is configured in similar fashion as the temperature comfort pad 410. For example, the temperature topper pad 610 can comprise a cool comfort side 620 that is configured to feel cool to the user when the user lays on it and a warm comfort side 630 that is configured to feel warm when the user lays on it. In some cases, the cool comfort side 620 can comprise a dual-layer fabric that feels cool to the user when the user lays on it. In other cases, the cool comfort side 620 can comprise a dual-layered moisture wicking fabric and/or material configured to provide a micro-climate area between the user and a surface of the mattress to allow for a highly breathable environment underneath the user. In yet other cases, the warm comfort side 630 can comprise a dual-layered fabric and/or material configured to be soft and luxurious feeling to the touch and/or configured to allow the user to maintain his or her body temperature. In some instances, the cool comfort side 620 and the warm comfort side 630 can comprise ceramic materials configured to reflect heat back to the user. In some instances, the warm comfort side 630 can comprise ceramic materials configured to take body heat from the user and reflect it back to the user in the form of far infrared rays. The temperature topper pad can comprise ceramic materials that absorb, emit, radiate and/or reflect far infrared radiation (e.g., fine-grained mica such as sericite mineral, FIR emitting ceramic nanoparticles, or fabrics with incorporated FIR absorbing, emitting, and or reflecting ceramic nanoparticles).

Referring now to FIGS. 8, 9A, 9B, and 9C, embodiments of a mattress core 700 are shown. With respect to the mattress core 700, it can be configured to provide a supportive and/or structural core to the mattress 10. In some embodiments, the mattress core 700 is configured to replace the base 200 and supporting layer 300 in the mattress 10. In other embodiments, the mattress core 700 is configured to be used with any other suitable component to allow the mattress 10 to function as intended. For example, the mattress core 700 can be used with one or more of the cover 100 and the comfort layer 400. Likewise, the mattress core 700 can be used with one or more of the cover assembly 500 and the topper layer 600. Similarly, the cover assembly 500 can be used to cover and/or contain the mattress core 700. The cover assembly 500 can be used to cover and/or contain the mattress core 700 and the topper layer 600 can be used on top of the cover assembly 500.

Figure 9A:
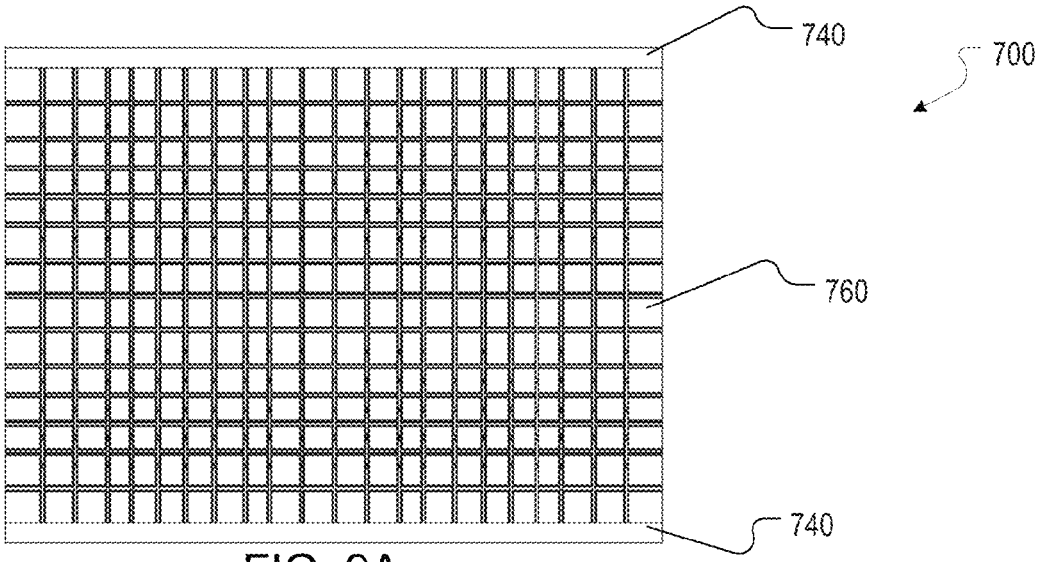
FIG. 9A illustrates a top view of embodiments of a mattress core.
Figure 9B:
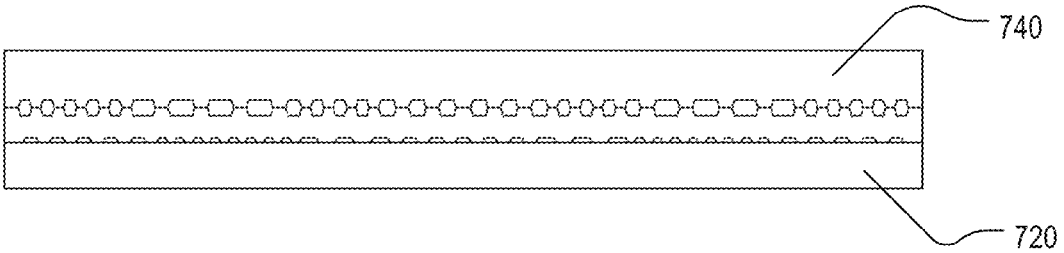
FIG. 9B illustrates a side view of embodiments of a mattress core.
Figure 9C:
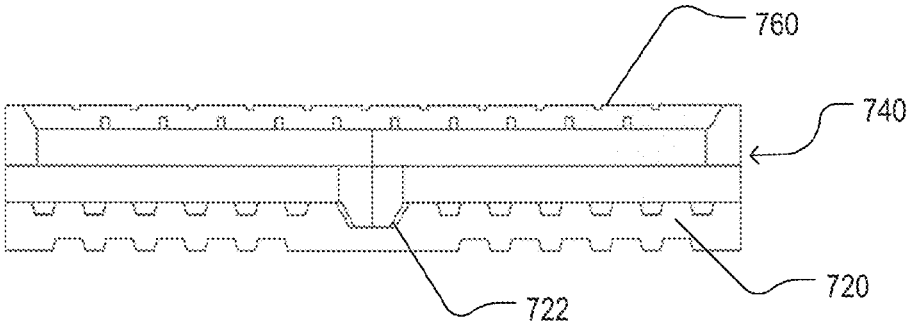
FIG. 9C illustrates an end view of embodiments of a mattress core.

While the mattress core 700 can have any suitable shape and/or dimension and can comprise any suitable component to allow it to function as intended, at least in some embodiments, the mattress core 700 comprises one or more of a base layer 720, a support pad assembly 740, and a comfort pad layer 760. In other embodiments, as shown in FIGS. 9A, 9B, and 9C, one or more of the base layer 720, the support pad assembly 740, and the comfort pad layer 760 are configured to detachably and selectively couple to form the mattress core 700. FIG. 9A shows a top view of the mattress core 700 and shows that, at least in some embodiments, the comfort pad layer 760 is disposed between a first and second support pad assembly 740. FIG. 9B shows a side view of the mattress core 700 and shows that, at least in some embodiments, the supporting pad assembly 740 is disposed above the base layer 720. FIG. 9C shows an end view of the mattress core 700 and shows that, at least in some embodiments, the base layer 720 is disposed at a bottom portion of the mattress core 700. The first and second support pad assembly 740 can be detachably and selectively coupled to a top portion of the base layer 720. The comfort pad layer 760 can be detachably and selectively coupled to a top portion of the first and second support pad assembly 740. In other embodiments, the first and second support pad assemblies 740 can be detachably and selectively coupled to the top portion of the base layer 720 via a coupling channel 722 in a top portion of the base layer 720.

Figure 10A:
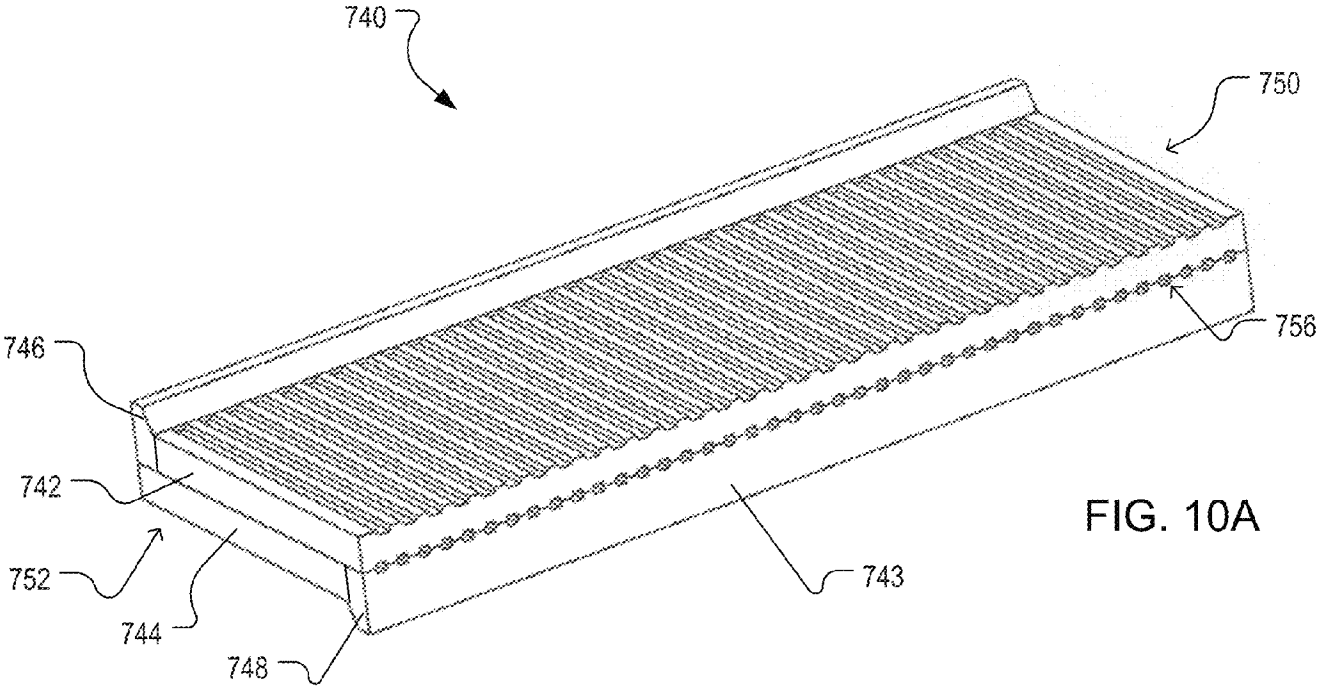
FIG. 10A illustrates a front perspective view of embodiments of a support pad assembly.
Figure 10B:
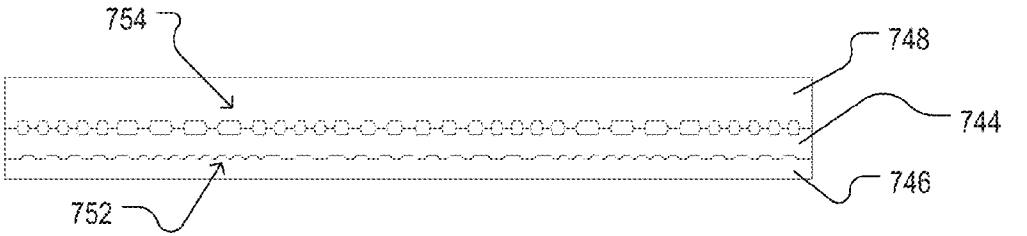
FIG. 10B illustrates a side view of embodiments of a support pad assembly.

Referring now to FIGS. 10A and 10B, some embodiments of the support pad assembly 740 are shown. In some embodiments, the support pad assembly 740 is configured to provide support to the mattress core 700. In other embodiments, the support pad assembly 740 is configured to detachably and selectively couple to the base layer 720. In yet other embodiments, the support pad assembly 740 is configured to detachably and selectively couple to the comfort pad layer 760. While the support pad assembly 740 can comprise any suitable component, at least in some embodiments, the support pad assembly 740 comprises one or more of a first pad 742, a second pad 744, a first side rail 746, and a second side rail 748. The first pad 742 can be disposed on the second pad 744. In some cases, the first pad 742 and the second pad 744 can be offset to allow for the first side rail 746 to be disposed against the first pad 742 and on top of the second pad 744. In other cases, the first pad 742 and the second pad 744 can be offset to allow for the second side rail 748 to be disposed against the second pad 744 and below the first pad 742. In some embodiments, the first side rail 746 is configured to provide side edge support to the mattress 10. In other embodiments, the first side rail 746 is configured to provide side edge support to the mattress core 700.

While the support pad assembly 740 can be configured in any suitable manner, at least in some embodiments, the support pad assembly 740 comprises the first pad 742, the second pad 744, the first side rail 746, and the second side rail 748. In some cases, each of the first pad 742, the second pad 744, the first side rail 746, and the second side rail 748 can be configured as individual components that are combined to form the support pad assembly 740. For example, the first pad 742 and the second pad 744 can comprise different firmness and/or stiffness. Likewise, the first side rail 746 and the second side rail 748 can comprise a firmness and/or stiffness greater than that of the first pad 742 and the second pad 744. In other cases, one or more of the first pad 742, the second pad 744, the first side rail 746, and the second side rail 748 can be configured as individual components that are joined with adhesive to form the support pad assembly 740. In yet other cases, one or more of the first pad 742, the second pad 744, the first side rail 746, and the second side rail 748 can be configured as individual components that are joined by heat and/or welding to form the support pad assembly 740.

In some embodiments, the second side rail 748 is configured to detachably and selectively couple with the coupling channel 722 in the base layer 720. In other embodiments, the first side rail 746 is configured to detachably and selectively couple with the comfort pad layer 760. In some cases, the support pad assembly 740 can comprise one or more ventilation channels and/or ventilation holes configured to allow passage of one or more of air, heat, and moisture between the mattress core 700 and the surrounding environment. For example, the support pad assembly 740 can comprise ventilation channels 750 disposed on a top surface of the first pad 742. The support pad assembly 740 can also comprise ventilation channels 752 disposed on a bottom surface of the second pad 744.

In some cases, the support pad assembly 740 can also comprise ventilation holes 754. In other cases, ventilation holes 754 can traverse the second side rail 748. In some instances, the support pad assembly 740 can comprise ventilation holes 756. In other instances, the ventilation holes 756 can traverse the first side rail 746. In yet other instances, the ventilation holes 754 can join the ventilation holes 756 to allow passage of one or more of air, heat, and moisture through the support pad assembly 740. In some cases, the ventilation channels 750 can be connected to one or more of ventilation holes 754 and 756. In other cases, ventilation channels 752 can be connected to one or more of ventilation holes 754 and 756. While the ventilation channels 750, 752 can be connected to the ventilation holes 754, 756 in any suitable manner, at least in some embodiments, the ventilation channels 750, 752 can be connected to the ventilation holes 754, 756 by vertical channels and/or vertical holes. The ventilation channels 750, 752 can be connected to the ventilation holes 754, 756 to allow passage of one or more of air, heat, and moisture through the support pad assembly 740. For example, one or more of air, heat, and moisture can be drawn along the ventilation channels 750, 752 and can be transferred to the ventilation holes 754, 756 and can then be passed into the surrounding environment.

In some embodiments, one or more of the first pad 742, the second pad 744, the first side rail 746, and the second side rail 748 are bonded together. For example, one or more of the first pad 742, the second pad 744, the first side rail 746, and the second side rail 748 can be bonded together by adhesive. In some cases, one or more of the first pad 742, the second pad 744, the first side rail 746, and the second side rail 748 can be joined and/or fused together by heat (e.g., welding). In other cases, one or more of the first pad 742, the second pad 744, the first side rail 746, and the second side rail 748 can be configured to be formed as a single piece. In yet other cases, one or more of the first pad 742, the second pad 744, the first side rail 746, and the second side rail 748 can be joined by fasteners (e.g., hook and loop fasteners). In some cases, the bonding of the first pad 742, the second pad 744, the first side rail 746, and the second side rail 748 with adhesive is carried out without obstructing one or more of the ventilation channels 750, ventilation channels 752, ventilation holes 754, ventilation holes 756, and any vertical channels and/or vertical holes that join them.

In some embodiments, the first pad 742 comprises a coupling surface 743. In other embodiments, the coupling surface 743 is configured to couple with another coupling surface 743 when the first and second support pad assemblies 740 are detachably and selectively coupled to the coupling channel 722 of the base layer 720. In some cases, the coupling surface can be configured to detachably and selectively couple with another coupling surface 743 with a friction fit. In other cases, the coupling surface can be configured to detachably and selectively couple with another coupling surface 743 with any suitable fastener (e.g., a zipper, hook and loop fastener, buttons, clasps, grommets, hooks, straps, snaps, etc.). In yet other cases, the coupling surface 743 can be configured to detachably and selectively couple with another coupling surface 743 such that an angled joint is formed and any uncomfortable ridge is avoided. For example, the coupling surface 743 can be beveled such that at least a portion of one coupling surface 743 overlaps with a portion of the adjoining coupling surface 743. A portion of the first coupling surface 743 can be angled with respect to vertical such that an outer edge of the first coupling surface 743 can overhang an outer edge of the second adjoining coupling surface 743. In this manner, the interface between the first coupling surface 743 and the second coupling surface is angled rather than perpendicular to the largest plane of the first pad. In some cases, the coupling surface 743 can be configured to detachably and selectively couple with another coupling surface 743 with interdigitated portions such that an uncomfortable ridge is avoided.

In some embodiments, the first and second support pad assemblies 740 are configured to be arranged side-by-side and to be detachably and selectively coupled to the coupling channel 722 of the base layer 720. As shown in FIGS. 9C and 10A, in some cases, the respective coupling surfaces 743 can be abutted and the respective second side rails 748 of the first and second support pad assemblies 740 can be fitted to the coupling channel 722. In other cases, as shown in FIGS. 9C and 10A, the respective second side rails 748 can be beveled and/or sized and shaped to be received by a similarly beveled coupling channel 722. While the respective second side rails 748 and the coupling channel 722 are shown as beveled, in yet other cases, the second side rails 748 and the coupling channel 722 can be configured with any suitable shape that allows the coupling channel 722 to receive and/or secure the second side rails.

In some embodiments, the first side rails 746 of the first and second support pad assemblies are configured to receive and/or to secure the comfort pad layer 760. In some cases, the first and second support pad assemblies 740 are first arranged side-by-side and then detachably and selectively coupled to the coupling channel 722 of the base layer 720 to position the second side rails 748 on either side of the mattress core 700. With the second side rails 748 positioned on either side of the mattress core 700, the second side rails 748 can receive and/or secure the comfort pad layer 760. In other cases, the respective first side rails 748 can be beveled and/or sized and shaped to receive a similarly beveled and/or sized and shaped comfort pad layer 760. In yet other cases, the first side rails 748 can be configured to provide edge support to the mattress core 700.

In some embodiments, the support pad assemblies 740 can be configured to be inverted such that sizing and/or shaping of the first pad 742 and first side rail 746 are similar or identical to the second pad 744 and the second side rail 748. In other embodiments, the first side rail 746 can be configured to be received in the coupling channel 722 and also configured to receive the comfort pad layer 760. Similarly, the second side rail 748 can be configured to be received in the coupling channel 722 and also configured to receive the comfort pad layer 760. In some cases, the user can detachably and selectively couple the first and second support pad assemblies 740 side by side in the base layer 720 with either the first pad 742 or second pad 744 facing up. If the user desires, he or she can remove one or both of the support pad assemblies 740, invert and rearrange the removed support pad assembly 740 and recouple the removed support pad assembly 740 to the base layer 720. In this manner, the user can select whether the first pad 742 or the second pad 744 is facing up and likewise whether the first pad 742 or second pad 744 contacts the base layer 720. Similarly, in this fashion, the user can select whether the first side rail 746 is received by the coupling channel 722 or provides edge support to the mattress core 700 (and consequently, whether the second side rail 748 is received by the coupling channel 722 or provides edge support to the mattress core 700).

In some embodiments, individual support pad assemblies 740 comprise different firmness and/or support levels. In other embodiments, the first pad 742 and the second pad 744 comprise different firmness and/or support levels. In some cases, a firmness level scale of 1 to 12 can be used to describe the firmness and/or support of the pads 742, 744, with a firmness level of 1 representing the softest feeling and a firmness level of 12 representing the firmest feeling. In other cases, a selected first pad 742 and a selected second pad 744 can be used to achieve a preferred firmness. For example, a first pad 742 and a second pad 744 of firmness scale levels of 6 and 8, respectively, can be used. The user can place the pad with the firmness level 6 in the upper position and the pad with the firmness level 8 in the bottom position to get a softer feeling sleep experience. Likewise, the user can place the pad with the firmness level 8 in the upper position and the pad with the firmness level 6 in the bottom position to get a firmer feeling sleep experience. Similarly, the user can use pads 742, 744 of firmness 2 and 4 for a softer feeling sleep experience. Additionally, the user can use pads 742, 744 of firmness scale levels of 10 and 12 to achieve a firmer feeling sleep experience. Therefore, a user can use any combination of pads 742, 744 of firmness scale levels between 1 and 12 to achieve a preferred firmness and/or support level.

In some embodiments, the first pad 742 and/or second pad 744 comprises any suitable material configured to provide support to the mattress 10, the mattress assembly 20, the mattress core 700, and/or to a reclining user. For example, the first pad 742 and/or the second pad 744 can comprise any suitable polyurethane foam (e.g., high resilience climate polyurethane foam). In some cases, the first pad 742 and/or second pad 744 can comprise a sheet of polyurethane foam between about 0.5 and 6 inches. In other cases, the first pad 742 and/or second pad 744 can comprise polyurethane foam of about 2 to about 3 inches thickness. In yet other cases, the first pad 742 and/or second pad 744 can comprise one or more of foam rubber, polyurethane foam, reticulated foam, open-cell-structured foams, closed-cell foams, sandwich-structured composite materials, and other similar materials. In other embodiments, the first pad 742 and/or second pad 744 comprise one or more of animal hair, feathers, down, straw, cotton, egg-crate foam, polyurethane foam, latex foam, felt, polyester fiber, cotton fiber, wool fiber, plant fiber, and nonwoven fiber pads.

In some embodiments, one or more of the first pad 742, the second pad 744, the first side rail 746, and the second side rail 748 comprise polyurethane foam comprising indentation load force deflection (ILD) ratings of between about 5 lb./50 $in^2$ to about 80 lb./50 $in^2$, and any subrange thereof. In some instances, the first side rail 746 and/or the second side rail 748 can comprise an ILD rating of above about 15 lb./50 $in^2$. In other instances, the first side rail 746 and/or the second side rail 748 can comprise an ILD rating of above about 23 lb./50 $in^2$. In yet other instances, the first side rail 746 and/or the second side rail 748 can comprise an ILD rating of above about 35 lb./50 $in^2$. In some cases, the first side rail 746 and/or the second side rail 748 can comprise an ILD rating of above about 45 lb./50 $in^2$. In other cases, the first side rail 746 and/or the second side rail 748 can comprise an ILD rating of above about 60 lb./50 $in^2$.

In some instances, the first pad 742 and/or the second pad 744 can comprise ILD ratings of between about 15 lb./50 $in^2$ and 45 lb./50 $in^2$. While the first pad 742 and the second pad 744 can comprise any combination of ILD ratings, at least in some cases, the first pad 742 and second pad 744 can each comprise a different ILD rating to achieve a certain firmness and/or support level. For example, a soft-firmness support pad assembly 740 can comprise a first pad 742 comprising about a 15 lb./50 $in^2$ ILD rating and a second pad 744 comprising about a 23 lb./50 $in^2$ ILD rating. The combination of the first pad 742 with a 15 lb./50 $in^2$ ILD rating and the second pad 744 comprising about a 23 lb./50 $in^2$ ILD rating provides a soft-firmness support pad assembly 740. Additionally, orienting the support pad assembly 740 so that the first pad 742 faces the user gives a softer feel while orienting the support pad assembly 740 so that the second pad 744 faces the user gives a firmer feel. Thus, combining a first pad 742 comprising about a 15 lb./50 $in^2$ ILD rating and a second pad 744 comprising about a 23 lb./50 $in^2$ ILD rating provides a support pad layer 740 with an overall soft-firmness level of support and provides a softer feel variation (first pad 742 facing user) and a firmer feel variation (second pad 744 facing user).

In some embodiments, a medium-firmness support pad assembly 740 can comprise a first pad 742 comprising about a 23 lb./50 $in^2$ ILD rating and a second pad 744 comprising about a 35 lb./50 $in^2$ ILD rating. The combination of the first pad 742 with a 23 lb./50 $in^2$ ILD rating and the second pad 744 comprising about a 35 lb./50 $in^2$ ILD rating provides a medium-firmness support pad assembly 740. Additionally, orienting the support pad assembly 740 so that the first pad 742 faces the user gives a softer feel while orienting the support pad assembly 740 so that the second pad 744 faces the user gives a firmer feel. Thus, combining a first pad 742 comprising about a 23 lb./50 $in^2$ ILD rating and a second pad 744 comprising about a 35 lb./50 $in^2$ ILD rating provides a support pad layer 740 with an overall medium-firmness level of support and provides a softer feel variation (first pad 742 facing user) and a firmer feel variation (second pad 744 facing user).

In some embodiments, a firm-firmness support pad assembly 740 can comprise a first pad 742 comprising about a 35 lb./50 $in^2$ ILD rating and a second pad 744 comprising about a 45 lb./50 $in^2$ ILD rating. The combination of the first pad 742 with a 35 lb./50 $in^2$ ILD rating and the second pad 744 comprising about a 45 lb./50 $in^2$ ILD rating provides a firm-firmness support pad assembly 740. Additionally, orienting the support pad assembly 740 so that the first pad 742 faces the user gives a softer feel while orienting the support pad assembly 740 so that the second pad 744 faces the user gives a firmer feel. Thus, combining a first pad 742 comprising about a 35 lb./50 $in^2$ ILD rating and a second pad 744 comprising about a 45 lb./50 $in^2$ ILD rating provides a support pad layer 740 with an overall firm-firmness level of support and provides a softer feel variation (first pad 742 facing user) and a firmer feel variation (second pad 744 facing user).

Figure 11:
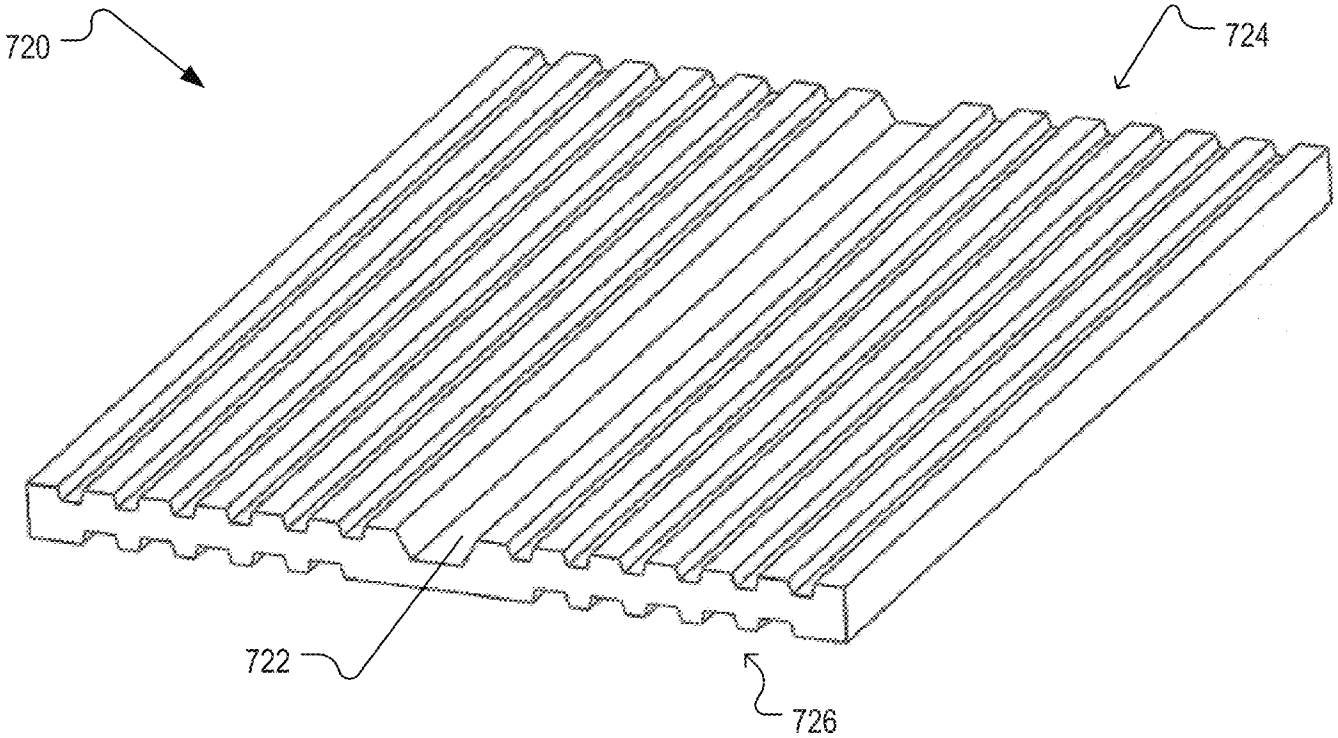
FIG. 11 illustrates a front perspective view of embodiments of a base layer.

Referring now to FIGS. 11A and 11B, some embodiments of the base layer 720 are shown. In some embodiments, the base layer 720 is configured to provide support to the mattress core 700. In other embodiments, the base layer 720 is configured to detachably and selectively receive one or more support pad assemblies 740. In yet other embodiments, the base layer 720 is configured to detachably and selectively receive one or more first side rails 746 in the coupling channel 722. While the base layer 720 can comprise any suitable component, at least in some embodiments, the base layer comprises the coupling channel 722. In some cases, the coupling channel 722 can be sized to receive two first side rails 746 side-by-side via a friction fit. In other cases, the coupling channel 722 can be configure to traverse a length of the base layer 720 and to be disposed about halfway along a width of the base layer 720. The base layer 720 can comprise ventilation holes and/or ventilation channels configured to allow passage of one or more of air, heat, and moisture between the mattress 10 and the surrounding environment. The base layer 720 can comprise top base ventilation channels 724 disposed along a top surface of the base layer 720. The base layer 720 can comprise bottom base ventilation channels 726 along a bottom surface of the base layer 720.

In some embodiments, the base layer 720 is configured to receive a first support pad assembly on a left side of the base layer 720 and to receive a second support pad assembly on a right side of the base layer 720. In some cases, the first support pad assembly can provide a first support preference to a first user and the second support pad assembly can provide a second support preference to a second user. In other cases, the support pad assembly 740 can be configured to be reversible such that the support pad assembly 740 can be inverted and the second side rails 748 can be detachably and selectively coupled with the coupling channel 722 and the first side rails 746 can abut the comfort pad layer 760.

In some embodiments, the base layer 720 comprises any suitable material that allows it to function as intended. For example, the base layer 720 can comprise one or more of a natural material such as rubber and/or a synthetic material. The base layer 720 can be configured to be rigid or semi-rigid. In some cases, the base layer 720 can be configured to be sufficiently rigid to provide support to the mattress core 700. For example, the base layer 720 can comprise a closed-cell foam which can be configured to provide support to the mattress core 700 and/or to detachably and selectively receive one or more second side rails 748 in the coupling channel 722. In other cases, the base layer 700 can comprise any suitable polyurethane foam. In yet other cases, the base layer 700 can comprise polyurethane foam between about 2 inches and about 8 inches thickness. In some instances, the base layer 700 can comprise polyurethane foam of about 4 inches thickness.

Figure 12:
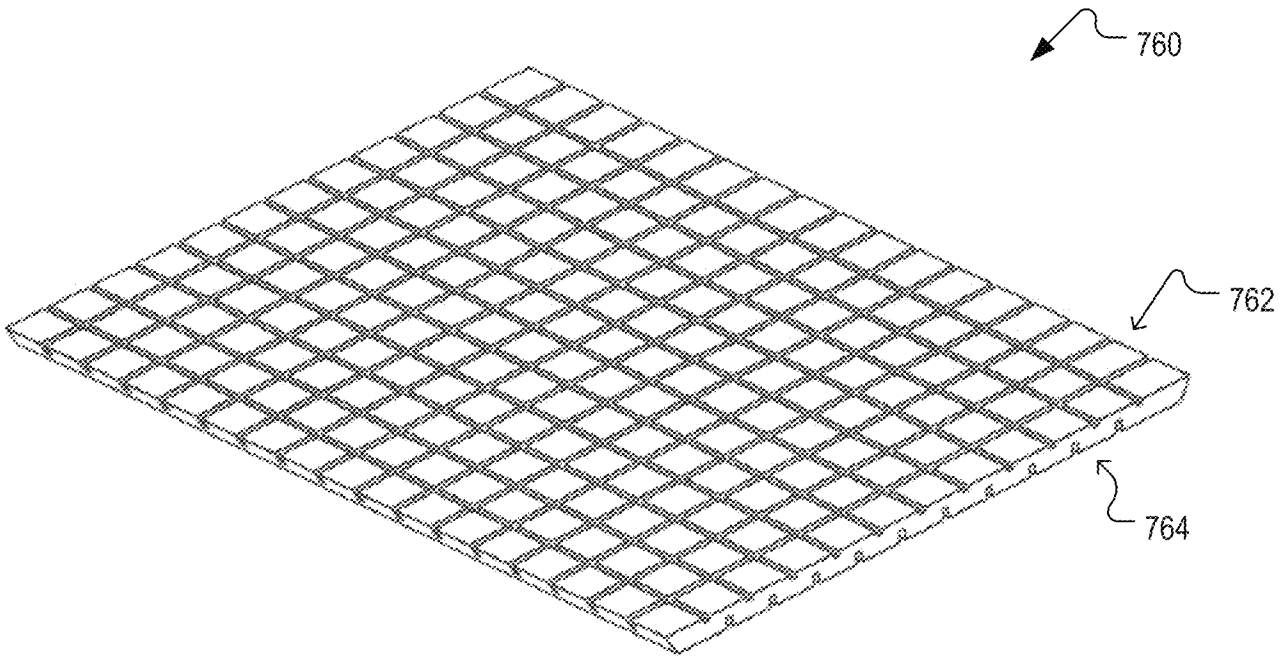
FIG. 12 illustrates a front perspective view of embodiments of a comfort pad layer.

Referring now to FIG. 12, some embodiments of the comfort pad layer 760 are shown. With respect to the comfort pad layer 760, it can be configured to provide a comfort layer to the mattress core 700. In some embodiments, the comfort pad layer 760 is configured to be received by one or more support pad assemblies. For example, the comfort pad layer 760 can be disposed on a first support pad assembly and a second support pad assembly with the comfort pad layer 760 disposed on the respective first pads 742 of the first and second support assemblies. The comfort pad layer 760 can also abut the respective second side rails 748 of the first and second support assemblies. In other embodiments, the comfort pad layer comprises ventilation holes and/or ventilation channels configured to allow passage of one or more of air, heat, and moisture between the mattress core 700 and the surrounding environment. In some instances, the comfort pad layer 760 can comprise upper comfort pad layer ventilation channels 762 that are disposed along a top surface of the comfort pad layer 760. In other instances, the comfort pad layer 760 can comprise lower comfort pad layer ventilation channels 764 that are disposed along a bottom surface of the comfort pad layer 760. In yet other instances, one or more upper comfort pad layer ventilation channels 762 and one or more lower comfort pad ventilation channels 764 intersect at sufficient depth to form at least one ventilation hole (e.g., a void, and/or other space that traverses a thickness of the comfort pad layer 760). In some cases, one or more upper comfort pad layer ventilation channels 762 and one or more lower comfort pad ventilation channels 764 intersect at sufficient depth in a crisscross pattern form a series of ventilation holes. In other cases, one or more upper comfort pad layer ventilation channels 762 and one or more lower comfort pad ventilation channels 764 intersect at sufficient depth at about perpendicular angles form a series of ventilation holes. The formed ventilation holes can be configured to allow passage of one or more of air, heat, and moisture between one or more of the comfort pad layer 760, the support pad assemblies 740, the topper layer 600, the mattress core 700, the mattress 10, the mattress assembly 20, and the surrounding environment.

While the comfort pad layer 760 can comprise any suitable material that allows it to function as intended, at least in some embodiments, the comfort pad layer 760 comprises viscoelastic polyurethane foam such as memory foam (e.g., low-resilience polyurethane foam and/or higher-density memory foam). In some cases, the comfort pad layer 760 comprises a sheet of memory foam between about 1 and 4 inches. In other cases, the comfort pad layer 760 comprises a sheet of memory foam of about 2 inches thickness. In yet other cases, the comfort pad layer 760 comprises one or more of foam rubber, polyurethane foam, reticulated foam, open-cell-structured foams, closed-cell foams, sandwich-structured composite materials, and other similar materials. In some instances, the comfort pad layer 760 can comprise a memory foam with an ILD rating of between about 5 lb./50 $in^2$ to about 35 lb./50 $in^2$. In other instances, the comfort pad layer 760 can comprise a memory foam with an ILD rating of between about 15 lb./50 $in^2$ to about 25 lb./50 $in^2$. In yet other instances, the comfort pad layer 760 can comprise a high resilience climate foam with an ILD rating of between about 15 lb./50 $in^2$ to about 25 lb./50 $in^2$.

In some embodiments, one or more of the components of the mattress core comprise an outer layer configured to reduce friction. In other embodiments, one or more of the base layer 720, the support pad assembly 740, and the comfort pad layer 760 comprise an outer layer to reduce friction to allow the user to easily assemble and/or disassemble the various components of the mattress core 700. In some cases, one or more of the base layer 720, the support pad assembly 740, and the comfort pad layer 760 can be covered with a material that reduces friction (e.g., a satiny textile, a foil covering, or a plastic covering) and/or allows for components to easily slide against one another to ease assembly and disassembly.

Figure 13:
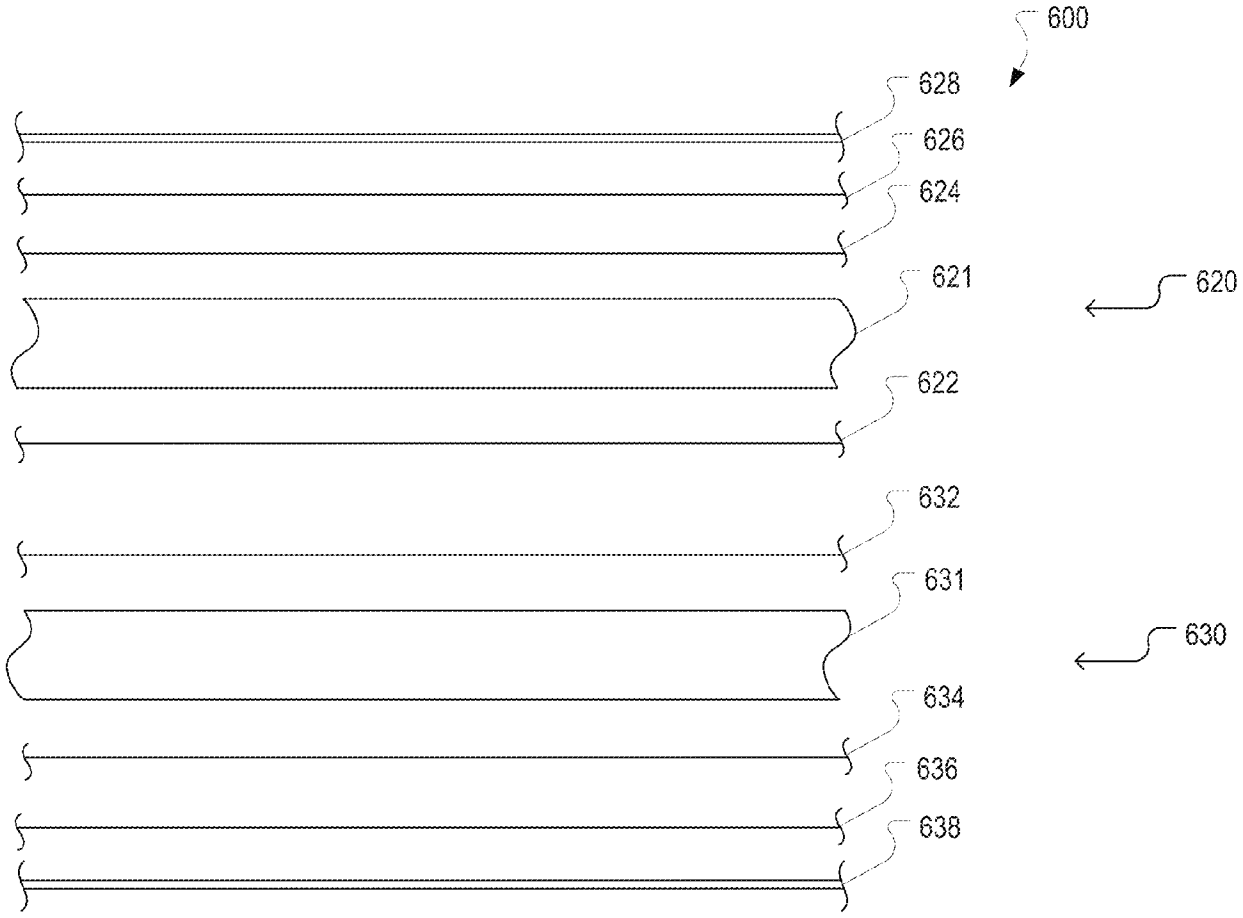
FIG. 13 illustrates an exploded cross-section view of a temperature topper pad.

Referring now to FIG. 13, an exploded cross-sectional view of some embodiments of the topper layer 600 is illustrated. As described above, in some embodiments the topper layer 600 comprises a cool comfort side 620 and a warm comfort side 630. While the cool comfort side 620 can be configured in any suitable manner, at least in some embodiments, the cool comfort side 620 comprises a cool comfort side core 621 covered by one or more fabric layers. In some cases, the cool comfort side core 621 can comprise any suitable material and can comprise any suitable thickness. In other cases, the cool comfort side core 621 can comprise viscoelastic foam. In yet other cases, the cool comfort side core 621 can comprise a thickness of about 0.2 inches to about 3 inches, and any subrange therein. The cool comfort side core 621 can also comprise viscoelastic foam of about 1 cm (about 0.4 inch) thickness. The cool comfort side core 621 can be covered by one or more of a backer fabric 622, a flame retardant barrier 624, a wool fabric layer 626, and a cooling fabric layer 628. Each of the backer fabric 622, a flame retardant barrier 624, a wool fabric layer 626, and a cooling fabric layer 628 can be arranged in any suitable configuration to cover the cool comfort side core 621. In some instances, the backer fabric 622 can be configured to contact the cool comfort side core 621 and to cover a surface of the cool comfort core 621 closest to the warm comfort side 630. The flame retardant barrier 624 can be configured to contact the cool comfort side core 621 and to cover a surface of the cool comfort core 621 farthest from the warm comfort side 630. The wool fabric layer 626 can be configured to cover the flame retardant barrier 624. The cool fabric layer 628 can be configured to cover the wool fabric layer 626. The cooling fabric layer 628 can comprise any suitable material (e.g., a 3D fabric such as Cairfull™, a 3D fabric such as Cairfull™ with IR properties such as those described above).

In some embodiments, the warm comfort side 630 comprises a warm comfort side core 631 covered by one or more fabric layers. In some cases, the warm comfort side core 631 can comprise any suitable material and can comprise any suitable thickness. In other cases, the warm comfort side core 631 can comprise viscoelastic foam. In yet other cases, the warm comfort side core 631 can comprise a thickness of about 0.2 inches to about 3 inches. The warm comfort side core 631 can also comprise viscoelastic foam of about 1 cm (about 0.4 inch) thickness. The warm comfort side core 631 can be covered by one or more of a backer fabric 632, a flame retardant barrier 634, a wool fabric layer 636, and a warm fabric layer 638. Each of the backer fabric 632, a flame retardant barrier 634, a wool fabric layer 636, and a warm fabric layer 638 can be arranged in any suitable configuration to cover the warm comfort side core 631. In some instances, the backer fabric 632 can be configured to contact the warm comfort side core 631 and to cover a surface of the warm comfort core 631 closest to the cool comfort side 620. The flame retardant barrier 634 can be configured to contact the warm comfort side core 631 and to cover a surface of the warm comfort core 631 farthest from the cool comfort side 620. The wool fabric layer 636 can be configured to cover the flame retardant barrier 634. The warm fabric layer 638 can be configured to cover the wool fabric layer 636. The backer fabric 632 can comprise any suitable fabric. In some cases, the backer fabric 632 can comprise IR properties such as those described above). The warm fabric layer 638 can comprise any suitable material (e.g., an ultra-soft fabric such as TENCEL™).

Referring now to FIGS. 14A, 14B, 14C, and 14D, cutaway views of the cover assembly 500 are illustrated. In some embodiments, the cover assembly 500 comprises one or more straps 550. The straps 550 can be configured to assist the user in removing the first support pad assembly 740 and/or the second support pad assembly 740 from the base layer 720 and/or the cover assembly 500. The straps 550 can also be configured to assist the user in removing the first and second support assemblies 740 from the base layer 720 to replace the first and/or second support pad assembly 740 and/or to invert the first and/or second support pad assembly 740. The straps 550 can be attached to at least a portion of the cover assembly 500. While the straps 550 can be attached in any suitable manner to the cover assembly 500, at least in some cases, the straps 550 can be attached to a lower portion of a side portion of the cover assembly 500. The straps 550 can also be disposed along a top portion of the base layer 720 and underneath the respective support pad assembly 740 such that lifting the straps 550 lifts at least a portion of the respective support pad assembly 740 out of the base layer 720 and/or the cover assembly 500.

Figure 14A:
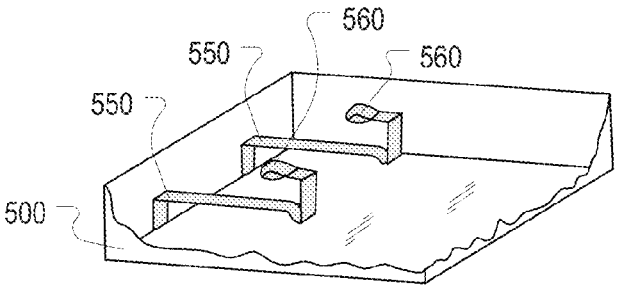
FIG. 14A illustrates a cutaway view of a cover assembly with straps.
Figure 14B:
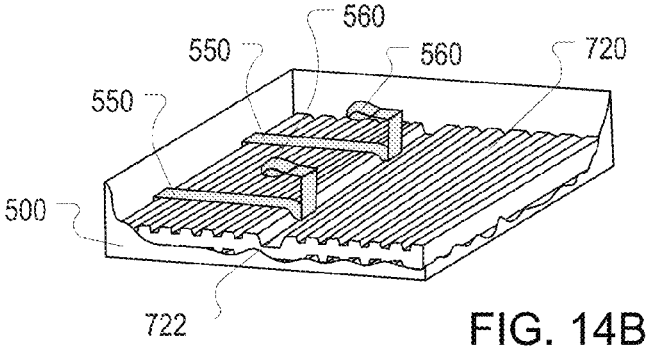
FIG. 14B illustrates a cutaway view of a cover assembly with straps and a base layer.
Figure 14C:
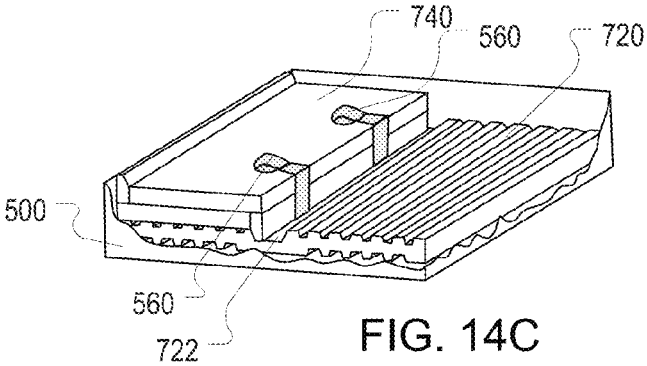
FIG. 14C illustrates a cutaway view of a cover assembly with straps, a base layer, and a support pad assembly.
Figure 14D:
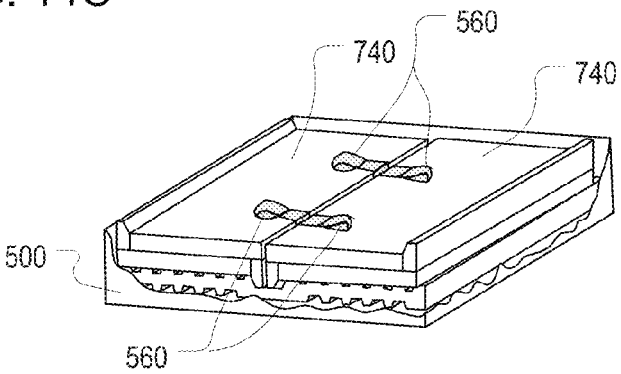
FIG. 14D illustrates a cutaway view of a cover assembly with straps, a base layer and two support pad assemblies.

As shown in FIGS. 14A, 14B, and 14C, in some cases, the straps 550 can be disposed along a top portion of the base layer 720 and can wrap at least in part around a bottom portion and a side portion of the respective support pad assembly 740. In other cases, the straps 550 can extend along at least a portion of a top portion of the respective support pad assembly 740. In yet other cases, the straps 550 can also extend into the coupling channel 722 to accommodate the second side rail 748 of each respective support pad assembly 740. As shown in FIG. 14D, a first set of straps 550 can be configured to lift the first support pad assembly 740 and a second set of straps 550 can be configured to lift the second support pad assembly 740. In some cases, the first and second set of straps 550 extend through an interface between the first support pad assembly 740 and the second support pad assembly 740.

In some cases, the straps 550 can comprise one or more handles 560 configured to provide a grasping portion for the user. Each strap 550 can be attached to a portion of the bottom cover assembly 510 at one end and attached to a handle 560 at the other end, thereby allowing the user to lift the straps 550 by the handles 560 to lift the respective support pad assembly 740 free of the base layer 720 and/or cover assembly 500. In other cases, the user can lift the first support pad assembly 740 by standing along a side portion of the cover assembly 500 and by facing the cover assembly 500. The user can then grasp the handles 560 of the first set of straps 550 and pull the straps 550 towards himself or herself. Pulling the first set of straps 550 lifts at least a portion of the first support pad assembly 740 and the user can remove the first support pad assembly 740. The user can also remove the second support pad assembly 740 in similar manner using the second set of straps 550.

The straps 550 can comprise any suitable material to allow them to function as intended. For example, the straps 550 can comprise flat webbing, flat strapping material, synthetic strapping, woven strap material, strapping made from natural fibers, rope, cloth, and other similar materials. Likewise, the handles 560 can also comprise any suitable material and/or component. For example, the handles 560 can be formed by folding over a length of the straps and attaching the free end to create a handle. In some cases, the handles 560 can comprise one or more of loops, pulls, grips, holes, grommets, and other similar components.

In some embodiments, the present application also discloses methods for customizing, assembling, and/or disassembling a modular multi-component mattress. For example, the user can customize and assemble a mattress by selecting each of the components and then assembling the components into an assembled modular multi-component mattress. The user can select a cover (or a cover assembly) based on size, fabric, style, breathability, and other similar factors. The user can then select a base based on size, styling, venting, construction, and other similar factors. The user can then select support pads based on materials, construction, venting, firmness, and other similar factors. The user can select comfort pads based on firmness comfort preference and/or preference of rebound response rate. Likewise, the user can select components of the mattress core based on support preferences. Similarly, the user can select the topper layer and topper pads based on temperature comfort preferences. Once the components have been selected, the user can purchase them from a retail or warehouse store and transport them to his or her house. Alternately, the user can select and/or order the components through a website and either pick up the components or have the components delivered to his or her house.

In some embodiments, once the components have arrived at the user's home, the user assembles the modular multi-component mattress. The user can insert the base into the bottom cover portion and position the support pads within the base. The user can then orient the comfort pads onto the support pads and engage the comfort pads with the base. The user then installs the top cover portion and attaches it to the bottom cover portion. The user(s) can then use the mattress.

In some embodiments, the user assembles the mattress core by laying the base layer on a flat surface. The user can then detachably and selectively couple the first support pad assembly on a left side of the base layer and a second support pad assembly on a right side of the base layer. The user can engage each first side rail of the respective first and second support pad assemblies into the coupling channel of the base layer. The user can then fit the comfort pad layer onto the support pads and fit the comfort pad layer between each second side rail of the respective first and second support pad assemblies. The user can then envelope the mattress core with the cover assembly. The user can then fit the topper layer on the cover assembly. In other embodiments, the user can use the mattress core with the cover and comfort layer.

In some instances, the user can disassemble the mattress to clean and/or launder one or more of the components and then reassemble the mattress. In other instances, the user can disassemble the mattress to replace and/or upgrade components. For example, the user can replace support pads as desired to modify the firmness. In yet other instances, the user can invert one or more of the temperature topper pads to a desired temperature comfort preference (e.g., a cool comfort side or a warm comfort side). In some cases, the user can order replacement and/or upgrade components through a website and have them delivered to his or her home to be assembled into the mattress.

In some embodiments, the modular multi-component mattress comprises any suitable size and/or shape. Some examples of suitable sizes include, but are not limited to, small single, cot, single, twin, twin XL, bunk, single extra-long, king single, super single, small double, three-quarter, double, full, double extra-long, queen, expanded queen, super queen, Olympic queen, king, California king, king long, grand king, super king, athletic king, Texas king, and Titan. In other embodiments, the modular multi-component mattress is configured to be used with any suitable bed, bed frame, or bed system. Suitable beds can include bed frames with box springs, bed frames without box springs, adjustable beds, box beds, brass beds, bunk beds, loft beds, captain's bed, camp bed, canopy bed, four poster bed, daybed, futon bed, hideaway bed, hospital bed, infant bed, Murphy bed, platform bed, rollaway bed, sofa bed, trundle bed, and bed foundations using slats, adjustable slats, multipoint, or any combination of such.

The terms "a," "an," "the" and similar referents used in the context of describing the disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the disclosure and does not pose a limitation on the scope of the disclosure otherwise claimed. No language in the specification should be construed as indicating any non-claimed element essential to the practice of the disclosure.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

Groupings of alternative elements or embodiments of the disclosure disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this disclosure are described herein, including the best mode known to the inventors for carrying out the disclosure. Of course, variations on these described embodiments will become apparent to those of ordinary skill in the art upon reading the foregoing description. The inventor expects skilled artisans to employ such variations as appropriate, and the inventors intend for the disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

I claim:

1. A mattress core comprising:

a base layer comprising a middle portion having a coupling channel;

a support pad assembly detachably and selectively coupled to the base layer, wherein the support pad assembly comprises a first side rail disposed substantially along a first outer edge of the support pad assembly and a second side rail disposed substantially along a second outer edge of the support pad assembly opposite the first outer edge of the support pad assembly, wherein the support pad assembly is reversible such that the first side rail is disposed in the coupling channel when the mattress core is assembled or the second side rail is disposed in the coupling channel when the mattress core is assembled; and a comfort pad layer detachably and selectively coupled to the support pad assembly.

2. The mattress core of claim 1, wherein the support pad assembly is a first support pad assembly, further comprising a second support pad assembly, the second support pad assembly comprising a third side rail disposed substantially along a first outer edge of the second support pad assembly and a fourth side rail disposed substantially along a second outer edge of the second support pad assembly opposite the first outer edge of the second support assembly.

3. The mattress core of claim 2, wherein the second support pad assembly is reversible such that the third side rail is disposed in the coupling channel when the mattress core is assembled or the fourth side rail is disposed in the coupling channel when the mattress core is assembled.

4. The mattress core of claim 1, wherein the comfort pad layer is configured to provide a temperature comfort preference to a user.

5. The mattress core of claim 1, wherein the comfort pad layer comprises one or more ventilation channels.

6. A modular multi-component mattress system comprising:

a mattress core comprising:

a base layer comprising a coupling channel;

a first support pad assembly comprising a first side rail; and a second support pad assembly comprising a second side rail, wherein the first side rail and the second side rail are fitted side-by-side within the coupling channel when the mattress core is assembled.

7. The mattress system of claim 6, wherein the first support pad assembly comprises third side rail.

8. The mattress system of claim 6, wherein the second support pad assembly comprises a fourth side rail.

9. The mattress system of claim 6, wherein the first support pad assembly and the second support pad assembly comprise vents configured to allow passage of one or more of air, heat, and moisture between the mattress system and a surrounding environment.

10. The mattress system of claim 6, further comprising a comfort pad layer selectively coupled to a top portion of the first and second support pad assemblies when the mattress core is assembled, wherein the comfort pad layer comprises channels configured to allow passage of one or more of air, heat, and moisture between the mattress system and a surrounding environment.

11. The mattress system of claim 6, further comprising a cover assembly and a topper layer, wherein the cover assembly is configured to contain the mattress core, wherein the topper layer is configured to selectively couple to the cover assembly, wherein the topper layer comprises a topper pad, the topper pad comprising a cool comfort side and a warm comfort side.

12. A modular multi-component mattress system comprising:

a base layer comprising a coupling channel;

a support pad assembly comprising a pad and a side rail, wherein the side rail has a greater stiffness than the pad and selectively couples to the coupling channel;

a comfort pad layer; and a cover assembly configured to contain the base layer, the support pad assembly, and the comfort pad layer.

13. The mattress system of claim 12, wherein the support pad assembly is a first support pad assembly, further comprising a second support pad assembly that selectively couples to the coupling channel.

14. The mattress system of claim 12, further comprising a topper layer comprising a cool comfort side and a warm comfort side.

15. The mattress system of claim 14, wherein the topper layer is configured to detachably and-selectively couple with the cover assembly.

* * * * *